US008469015B2

(12) United States Patent
Gerwig

(10) Patent No.: US 8,469,015 B2
(45) Date of Patent: Jun. 25, 2013

(54) LOW COST RESCUE LAUNCHER SYSTEM

(76) Inventor: Phillip L. Gerwig, Perrysville, OH (US)

( * ) Notice: Subject to any disclaimer, the term of this patent is extended or adjusted under 35 U.S.C. 154(b) by 129 days.

(21) Appl. No.: 13/045,884

(22) Filed: Mar. 11, 2011

(65) Prior Publication Data

US 2011/0220087 A1 Sep. 15, 2011

Related U.S. Application Data

(60) Provisional application No. 61/313,362, filed on Mar. 12, 2010.

(51) Int. Cl.
*F41B 11/08* (2006.01)

(52) U.S. Cl.
USPC ..... 124/57

(58) Field of Classification Search
USPC ..... 124/57
See application file for complete search history.

(56) References Cited

U.S. PATENT DOCUMENTS 3,830,214 A * 8/1974 Curtis ..... 124/57
5,584,736 A 12/1996 Salvemini
5,690,524 A * 11/1997 Salvemini ..... 441/85
5,706,795 A * 1/1998 Gerwig ..... 124/71
5,895,300 A 4/1999 Borrelli
6,120,337 A * 9/2000 Bautista Real et al. ..... 441/88
RE36,965 E * 11/2000 Salvemini ..... 441/85
6,398,606 B1 6/2002 Borrelli
7,059,924 B2 6/2006 Farmer et al.
7,306,501 B2 12/2007 Pierce, Jr. et al.

OTHER PUBLICATIONS

Owner's Manual Float-Tech Model Nos. OGFT-AR5-1,2,3,4,5,6,7, 90-00001-2 rev c Jan. 4, 2005, Float-Tech Inc., Troy, New York, USA.
Operation Manual ALM Assualt Launcher Max, 2002, Rescue Solutions International, Inc., Vista, California, USA.

* cited by examiner

*Primary Examiner* — Samir Abdosh
(74) *Attorney, Agent, or Firm* — Porter, Wright, Morris & Arthur, LLP

(57) ABSTRACT

A rescue launcher system includes a reusable launcher and a one-time-use, pre-packed payload cartridge removably secured to the reusable launcher. The payload cartridge includes a plastic canister, a pressurization system located within the canister and selectively activated by reusable launcher, and a payload located within the canister and which is launched to a remote location upon actuation of the pressurization system. An actuation grip of the launcher selectively actuates the pressurization system, and an interlock is adapted to prevent actuation of the pressurization system unless the interlock and the actuation grip are simultaneously actuated. The payload can be a buoyancy device including a sealed tube and deflated foam within the sealed tube which inflates using internal vacuum after launch of the buoyancy device.

20 Claims, 17 Drawing Sheets

LOW COST RESCUE LAUNCHER SYSTEM

CROSS-REFERENCE TO RELATED APPLICATIONS

This application claims the priority benefit of U.S. Provisional Patent Application No. 61/313,362 filed on Mar. 12, 2010, the disclosure of which is expressly incorporated herein in its entirety by reference.

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to projectile launching systems, and more specifically, to rescue launcher systems that launch disposable quick-change, prepacked payload cartridges from a reusable launcher for a variety of public safety applications.

BACKGROUND OF THE INVENTION

In public safety, commercial/recreational marine, and animal net capture applications, currently available rescue launching devices are costly, complex, reusable systems that require significant training. Training and training costs are serious considerations for any such technology adoption. Due to their complex nature, a novice operator, or an operator with minimal training, may have difficulty in successfully deploying payloads using these existing products, especially in high stress environments that typically accompany rescues. The result is compromising rapid rescue and jeopardizing lives. The high system costs, payload packing/re-packing, and operational complexity limit wide scale deployment of existing technology, thereby limiting availability of the technology for rescues.

Using public safety as an example, according to 2008 Federal Emergency Management Agency (FEMA) data, there are 30,170 fire-rescue departments in the U.S. with a total of 1,498,850 firefighters. This number includes potential water/ice first responders. Approximately 72% of these firefighters are volunteers, and an estimated 53% of these firefighters are involved in technical rescue (e.g., water/ice and high angle) and lack formal training to do so. Water conducts heat from the body twenty five times faster than air. Therefore rapid rescue from water is crucial for survival, especially when ambient temperatures drop. Since a large portion of the U.S. is rural with various bodies of water, and most rural fire-rescue departments are unmanned and served by volunteers, the need for a first responder system to rapidly retrieve a water or ice rescue subject is substantial. Citing 2009 U.S. Lifesaving Association statistics, there were 79,138 rescues just by open water lifeguards. Worldwide, the need to respond to flood disasters and provide effective marine safety will increase as populations living near bodies of water and marine recreation multiply. Statistically the majority of water and ice rescues occur within 300 feet of shore. First responders with manually thrown tethered rescue devices have a typical range of approximately 60 feet, as this is limited by physical strength and accuracy skill. Therefore there is demand for accurate rescue launching systems capable of reaching 300 feet.

In a 2004 letter from the (U.S.) National Association for Search and Rescue (NASAR) to the (U.S.) International Association of Fire Chiefs (IAFC), there was a request to form a committee to address problems each organization had with water rescue. NASAR cited 1999 U.S. Centers for Disease Control statistics, in which 3,529 Americans died due to drowning and 7,940 were hospitalized for near-drowning. Drowning is the $10^{th}$ leading cause of death in the U.S. The letter cited that one-third of all drowning victims are would-be-rescuers and the National Fire Protection Association stated that a firefighter is four times more likely to lose their life in a water rescue situation than in fighting a fire.

One example of present technology is the costly (kits range from $1900 to $3300) ResQmax™ line rescue system. This system pulls a line or payload by opening a neck of a large and expensive compressed gas cylinder, thereby letting escaping gas jet tow the reusable line. All payloads in this system must be operator packed and repacked. This requires a high level of operator skill to prevent deployment tangling and delays rapid repeat launches when time is critical. The gas cylinders are heavy and potentially deadly if a rescue subject is struck by the gas cylinder. If the $350 gas cylinder lands on a hard surface, it may become dented, and therefore unserviceable. Accordingly, there is a need for improved rescue launcher systems that are less costly and can be widely deployed for use by minimally trained or novice first responders to initiate water, ice, animal net capture, and the like at safe distances and shortening response times for lifesaving critical rescues.

SUMMARY OF THE INVENTION

Disclosed herein are rescue launcher systems which overcome at least one of the deficiencies of the prior art. Disclosed are rescue launcher systems that are relatively low cost, require little operator knowledge due to its intuitive design, and launch a wide a variety of different payloads. Disclosed is a rescue launcher system comprising, in combination a reusable launcher and a one-time-use, pre-packed payload cartridge removably secured to the reusable launcher. The payload cartridge includes a plastic canister, a pressurization system located within the canister and selectively activated by reusable launcher, and a payload located within the canister and which is launched to a remote location upon actuation of the pressurization system.

Also disclosed is a rescue launcher system comprising, in combination, a reusable launcher having an actuation grip and an interlock and a payload cartridge removably secured to the reusable launcher. The payload cartridge includes a canister, a pressurization system located within the canister and selectively activated by reusable launcher, and a payload located within the canister and which is launched to a remote location upon actuation of the pressurization system. Actuation of the actuation grip actuates the pressurization system and the interlock is adapted to prevent actuation of the pressurization system unless the interlock and the actuation grip are simultaneously actuated.

Further disclosed is a rescue launcher system comprising, in combination, a reusable launcher and a payload cartridge removably secured to the reusable launcher. The payload cartridge houses a buoyancy device which is launched to a remote location upon actuation of the reusable launcher. The buoyancy device includes a sealed tube and foam within the sealed tube and the sealed tube and foam are mechanically restrained in a compressed state and adapted to inflate using internal vacuum when no longer mechanically restrained after launch of the buoyancy device.

From the foregoing disclosure and the following more detailed description of various preferred embodiments it will be apparent to those skilled in the art that the present invention provides a significant advance in the technology and art of rescue launcher systems. Particularly significant in this regard is the potential the invention affords for providing a reliable, low cost, and easy to use rescue system. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
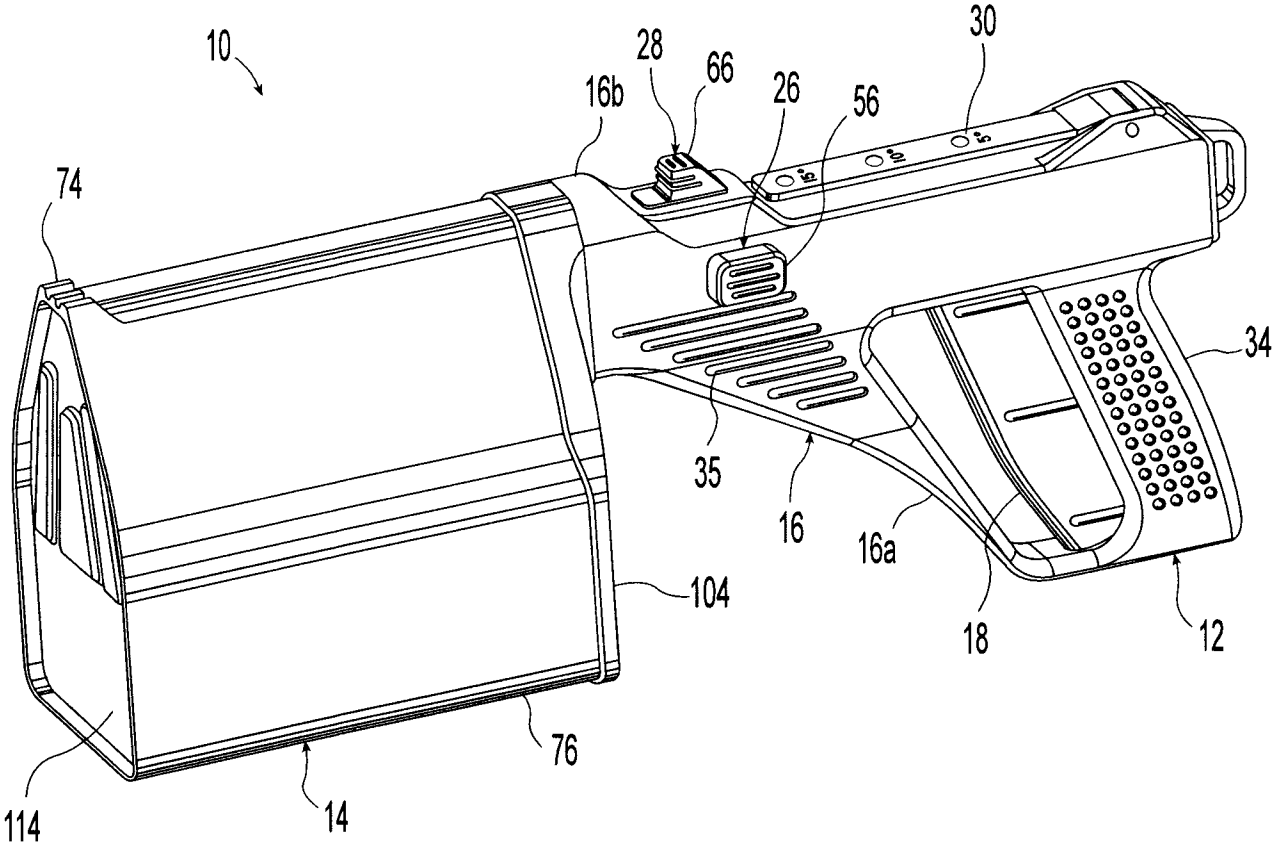
FIG. 1 is a perspective view of a rescue launcher system according to a preferred embodiment of the present invention wherein the rescue launcher system includes a reusable launcher and a disposable, quick-change, pre-packed payload cartridge.

It should be understood that the appended drawings are not necessarily to scale, presenting a somewhat simplified representation of various preferred features illustrative of the basic principles of the invention. The specific design features of the rescue launcher systems as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the rescue launcher systems illustrated in the drawings. In general, up or upward refers to an upward direction within the plane of the paper in FIG. 2 and down or downward refers to a downward direction within the plane of the paper in FIG. 2. Also in general, front or forward refers to a direction towards the left within the plane of the paper in FIG. 2 and rear or rearward refers to a direction towards the right within the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved rescue launcher systems disclosed herein. The following detailed discussion of various alternative and preferred embodiments will illustrate the general principles of the invention. Other embodiments suitable for other applications will be apparent to those skilled in the art given the benefit of this disclosure.

Figure 2:
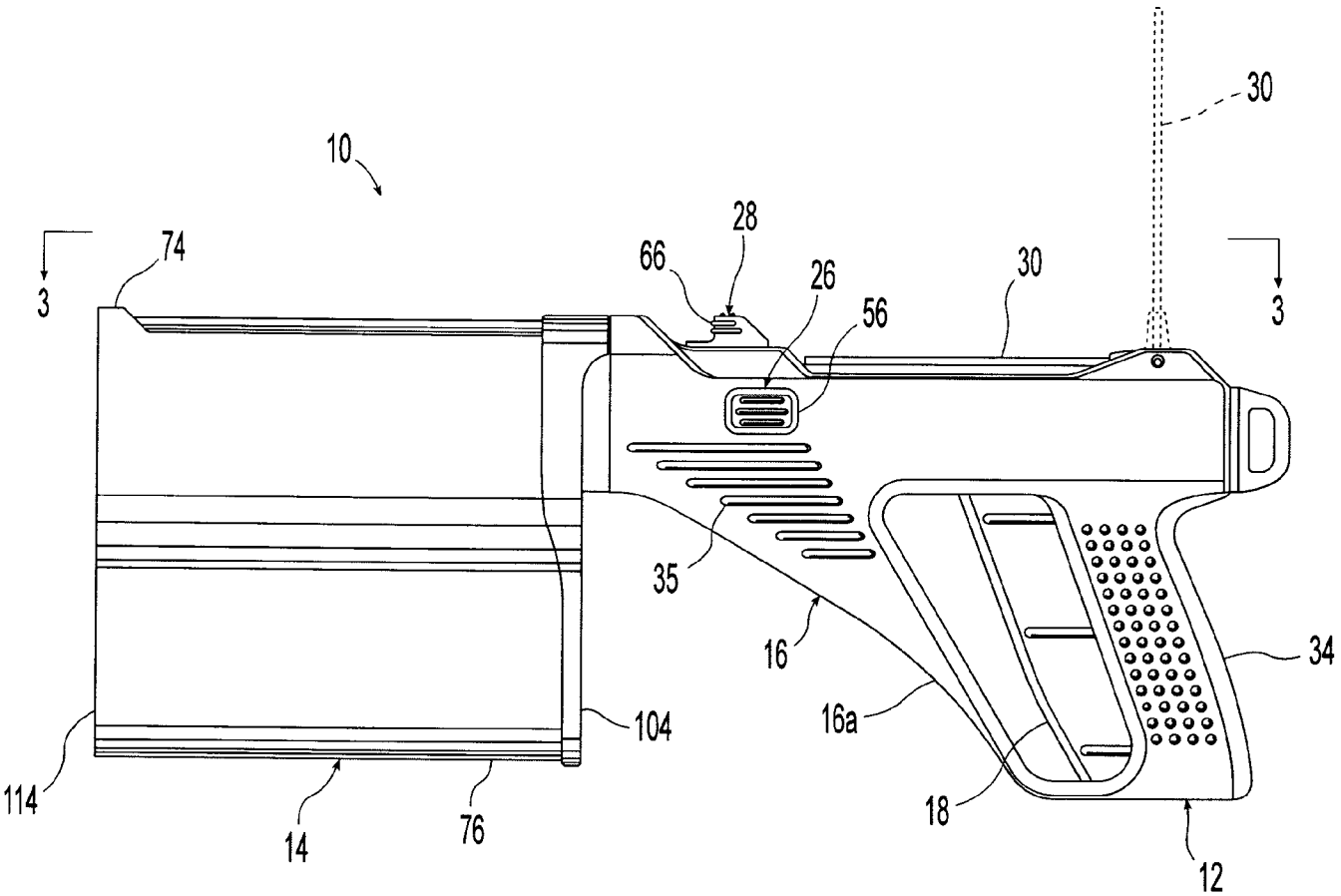
FIG. 2 is a left-side elevational view of the rescue launcher system of FIG. 1.
Figure 3:
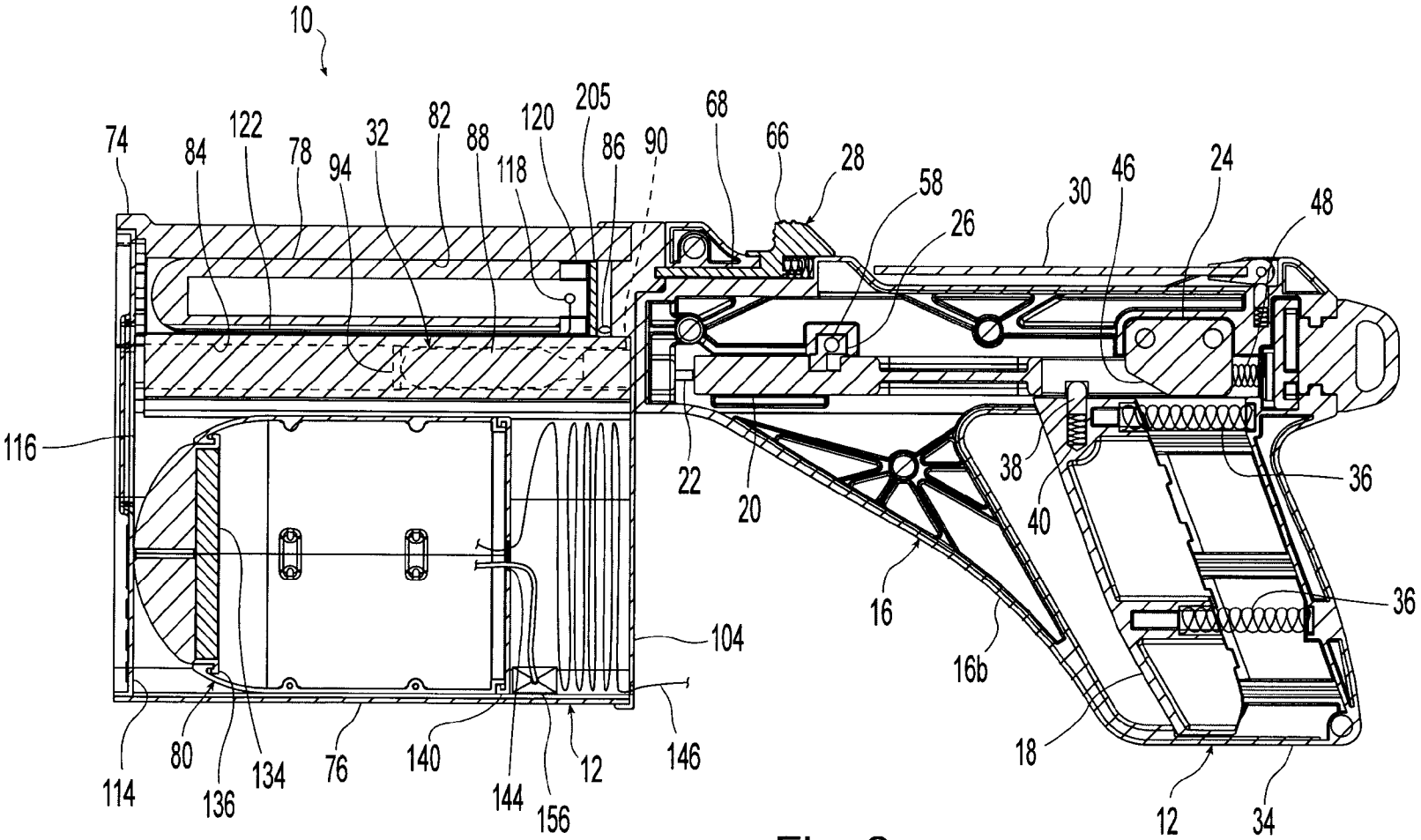
FIG. 3 is a cross-sectional view taken along line 3-3 of FIG. 2.

Referring now to the drawings, FIGS. 1 to 3 illustrate a rescue launcher system 10 according to the present invention. The illustrated rescue launcher system 10 includes a reusable launcher 12 and a disposable or one-time-use, quick-change, pre-packed payload cartridge 14 which is removably secured to the reusable launcher 12.

Figure 4:
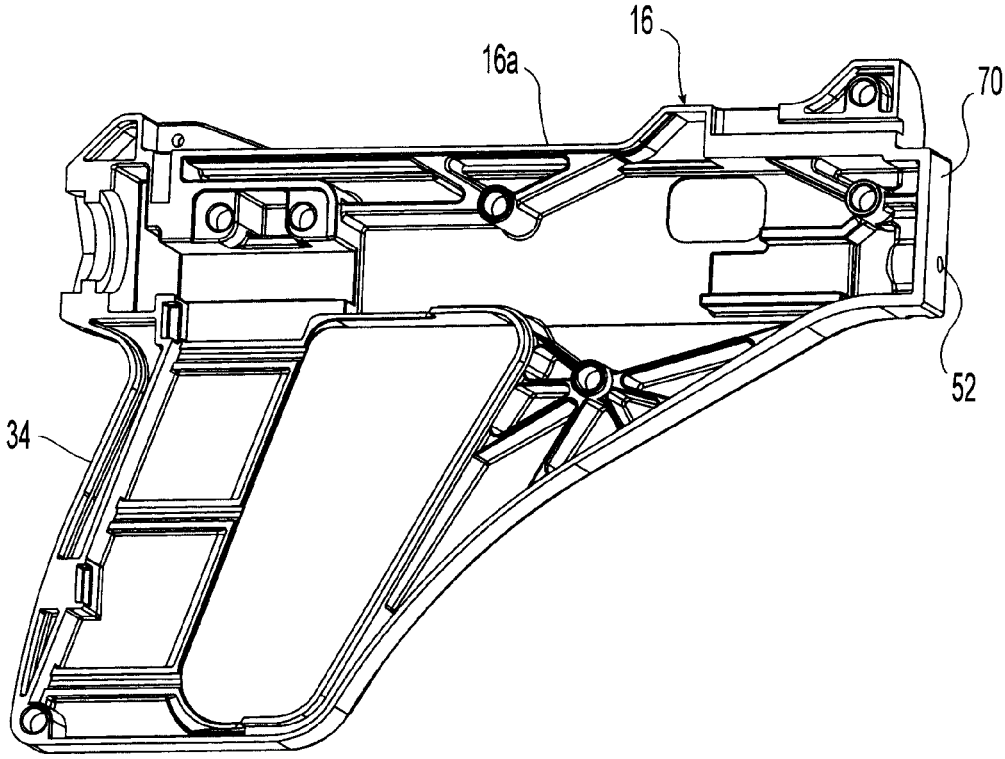
FIG. 4 is an elevational view of a left housing member of a launcher housing assembly of the rescue launcher system of FIGS. 1 to 3.

The illustrated reusable launcher 12 includes a housing or grip assembly 16, a "hand squeezed" actuation grip or trigger 18, a hammer 20, a pair of actuation pins 22, a release member 24, a safety interlock 26, a latch assembly 28, and a rear sight 30. The illustrated housing assembly 16 has a split injection molded design that confines operating components for initiating release of pre-pressurized gas from a pressurization system 32 contained in the payload cartridge 14. As best shown in FIGS. 3 and 4, the illustrated housing assembly 16 includes separate left and right housing members 16*a*, 16*b* which are laterally secured together and form cavities therein for housing various operating components therein as discussed in more detail hereinafter. The illustrated left and right housing members 16*a*, 16*b* are provided with a plurality of receptacles and a plurality of cooperating protrusions respectively for alignment and connection of the two housing members 16*a*, 16*b*. The left and right housing members 16*a*, 16*b* are preferably each injection molded of a suitable plastic material. The illustrated housing assembly 16 has a rear grip 34 downwardly extending from its rearward end and sized and shaped for grasping by the user's dominant hand. The illustrated rear grip 34 is provided with a plurality of protrusions to increase its slip resistance. The illustrated rear grip 34 is adapted to cooperate with the actuation grip 18 which is located at a forward side of the rear grip 34 and slides therein. The illustrated housing assembly 16 forms a guard in front of the actuation grip 18 to guard against accidental actuation of the actuation grip 18. The illustrated guard is sized and shaped so that a gloved hand can actuate the actuation grip 18. The illustrated housing assembly 16 also has a front grip 35 located near the forward end of the housing assembly 16 and sized and shaped for grasping by the user's non-dominant hand. The illustrated front grip 35 is provided with a plurality of protrusions to increase its slip resistance. The illustrated safety interlock 26 is located at the front grip 35 as described in more detail hereinafter.

Figure 5:
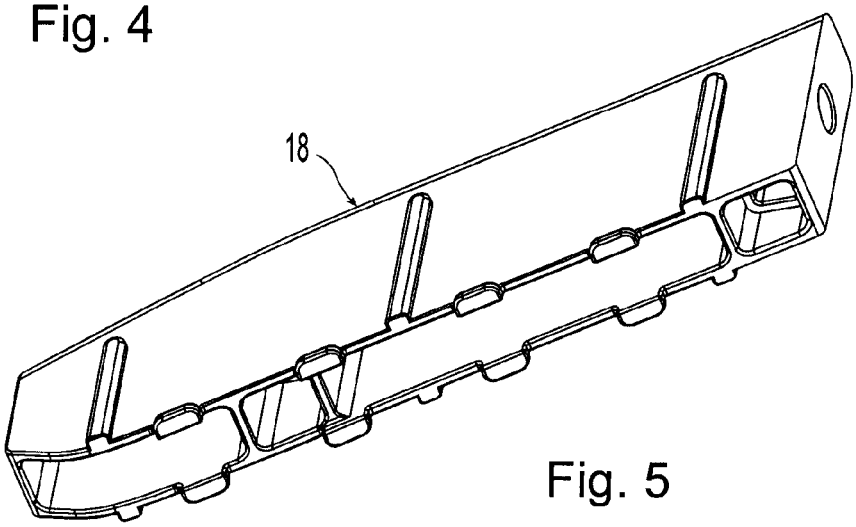
FIG. 5 is a perspective view of a left actuation grip of the launcher of the rescue launcher system of FIGS. 1 to 3.

As best shown in FIGS. 3 and 5, the actuation grip 18 is provided with a plurality of horizontal and vertically spaced apart rails which cooperated with a plurality of horizontal and vertically spaced apart grooves formed in the rear grip 34 so that the actuation grip 18 can move in the forward/rearward direction relative to the rear grip 34. The illustrated actuation grip 18 is provided with a pair of rearward facing and vertically spaced-apart pockets or spaces which receive compression springs 36 which act between the actuation grip 18 and the rear grip 34 to resiliently bias the actuation grip 18 in the forward direction. The illustrated actuation grip 18 is provided with a plurality of retaining tabs at its rearward end which limit forward movement of the actuation grip 18 relative to the rear grip 34 to retain the actuation grip 18 to the rear grip 34. The illustrated actuation grip 18 is sized and shaped so that it can be squeezed by the user's hand holding the rear grip 34 to rearwardly move the actuation grip 18 when it is desired to actuate the rescue launcher system 10. The actuation grip 18 is preferably injection molded of a suitable plastic material. An upper end of the illustrated actuation grip 18 is provided with an upward-facing bore or opening for a spring-biased detent sear 38 which cooperates to releasably secure the hammer 20 to the actuation grip 18 as described in more detail hereinafter. A compression spring 40 is provided below the detent sear 38 which acts between the detent sear 38 and the actuation grip 18 to resiliently bias the detent sear 38 in the upward direction.

Figure 6:
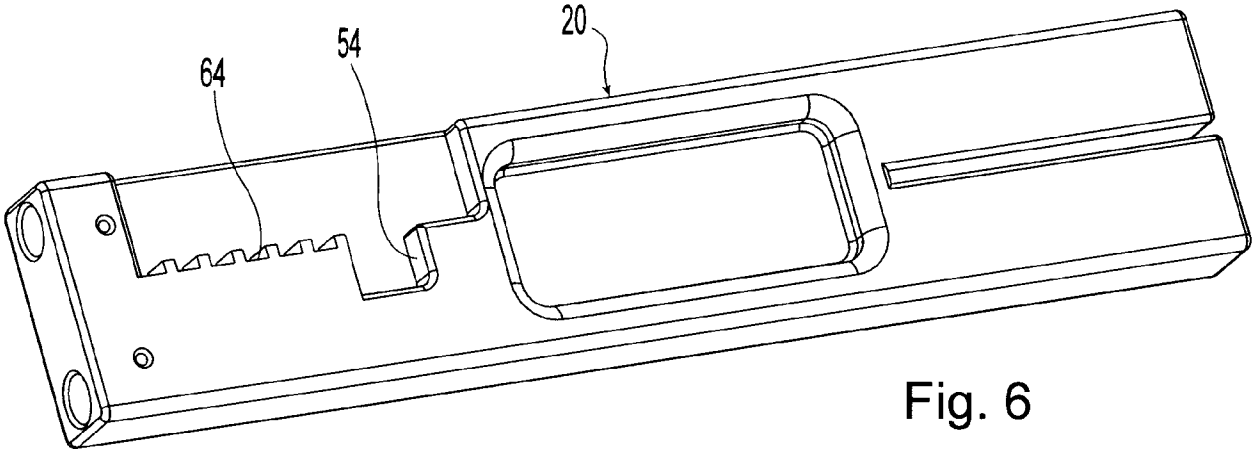
FIG. 6 is a top perspective view of a hammer of the launcher of the rescue launcher system of FIGS. 1 to 3.
Figure 7:
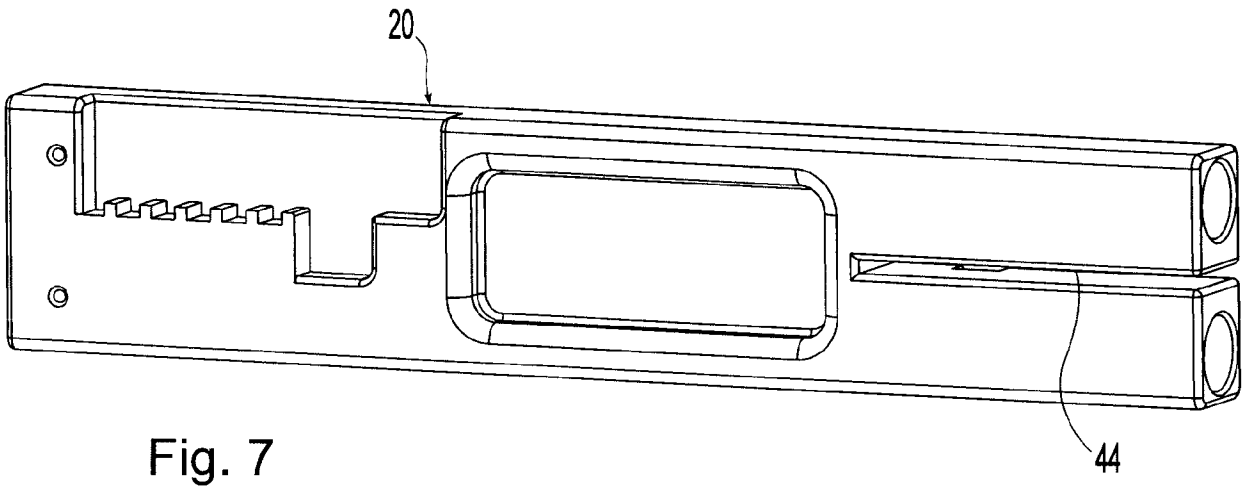
FIG. 7 is a bottom perspective view of the hammer of FIG. 6.
Figure 9:
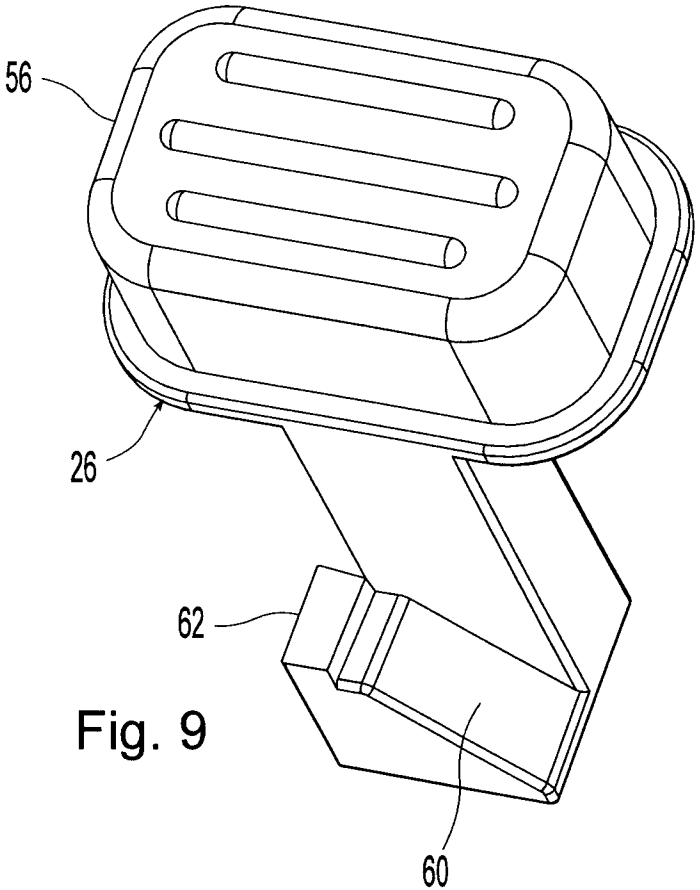
FIG. 9 is a perspective view of an interlock of the launcher of the rescue launcher system of FIGS. 1 to 3.

As best shown in FIGS. 3, 6, and 7, the illustrated hammer 20 is located above the actuation grip 18 and is releasably secured to the "squeeze to fire" actuation grip 18 by the detent sear 38 when the hammer 20 is at its forward rest or "battery" position (shown in FIG. 3). The lower side of the illustrated hammer 20 is provided with a downward facing receptacle for receiving the detent sear 38 therein. With the detent sear 38 extending into the receptacle, the hammer 20 rearwardly moves with the actuation grip 18 when the actuation grip 18 is squeezed by the user. The release member 24 is provided to disengage the detent sear 38 from the hammer 20 when the hammer 20 is rearwardly moved to a firing position. The illustrated release member 24 is a laterally-facing plate which is secured within the housing assembly 16 near the rear end of the hammer 20 and is received in a clearance slot 44 formed in the hammer 20 that extends through the receptacle. The illustrated release member 24 is provided with an angled cam surface or wedge 46 at its forward end such that the detent sear 38 is cammed downwardly against the bias of the compression spring 40 as the hammer 20 and the actuation grip 18 move in the rearward direction and the detent sear 38 engages the cam surface 46 of the release member 24. The illustrated hammer 20 is provided with a pair of laterally spaced apart and rearward facing receptacles or bores which receive compression springs 48. The illustrated compression springs 48 act between the hammer 20 and a spring base 50 captured by the housing assembly 16 to resiliently bias the hammer 20 in the forward direction. When the detent sear 38 is released from the hammer 20, the compression springs 48 rapidly move the hammer 20 in the forward direction. The hammer 20 and the spring base 50 are each preferably injection molded of a suitable plastic material.

Figure 8:
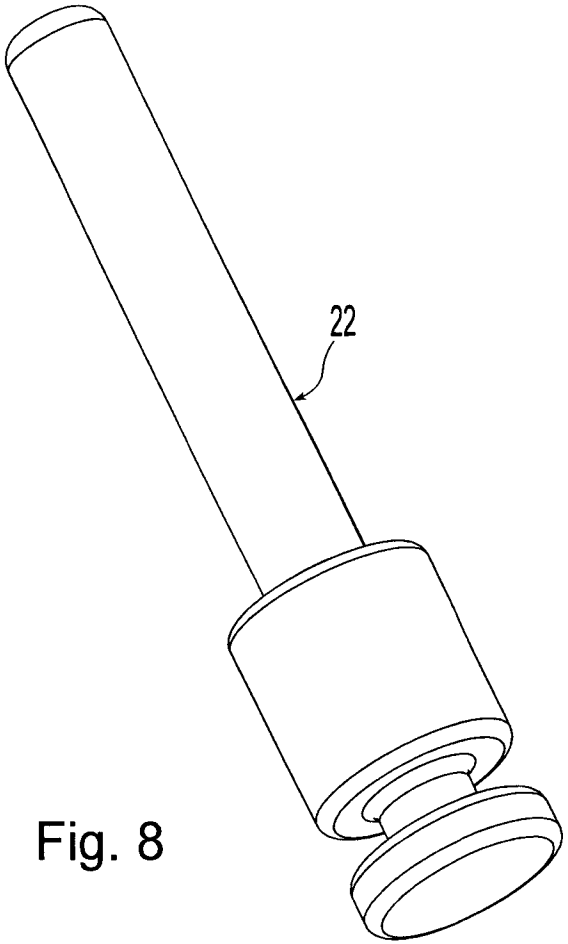
FIG. 8 is a perspective view of an actuator pin of the launcher of the rescue launcher system of FIGS. 1 to 3.

As best shown in FIGS. 3, 6, and 8, the illustrated hammer 20 is provided with a pair of laterally spaced apart and rearward facing receptacles or bores which receive the actuation pins 22. The actuation pins 22 have a forward portion sized and shaped to cooperate with the payload cartridge 14 and a rear portion sized and shaped to cooperate with the bores of the hammer 20. The rear portions of the illustrated actuation pins 22 are provided with a groove for receiving dowel pins which extend through vertical openings in the hammer 20 to secure the actuation pins 22 to hammer 20. Secured in this manner, the actuation pins 22 forwardly extend from the forward end of the hammer 20 and extend through openings 52 provided in the forward end of the housing assembly 16 when the hammer 20 is in its forward most position. It is noted that a lesser or greater quantity of actuation pins 22 can be alternatively utilized if desired.

As best shown in FIGS. 2, 3, 6, and 9, the illustrated hammer 20 is provided with a laterally facing notch 54 which cooperates with the spring-biased safety interlock 26 to position the hammer 20 in its "battery" position. The illustrated safety interlock 26 is provided with a laterally-facing push button 56 which extends through an opening in the housing assembly 16 at the front grip 35 near a forward end of the housing assembly 16. The illustrated safety interlock 26 is also provided with a laterally-facing receptacle or bore receiving a compression spring 58 to resiliently bias the safety interlock 26 into engagement with the hammer 20. The illustrated compression spring 58 acts between the safety interlock 26 and the housing assembly 16 to resiliently bias the push button 56 in a laterally outward direction (towards the left in the illustrated embodiment). The illustrated safety interlock 26 further has a "pre-positioning" angled surface 60 that engages the hammer notch 54 to position the hammer 20 so that the actuation pins 22 are behind the mating surfaces of the payload cartridge 14 and the receiver hole for hammer detent sear 38 is aligned with the actuation grip detent sear 38 to secure the hammer 20 to the actuation grip 18. In this position, the actuation grip 18 cannot be drawn rearward by the user until the safety interlock push button 56 is depressed. The illustrated spring-biased safety interlock 26 has a protrusion "dog" or locking tooth 62 that drops into a plurality of spaced-apart and laterally facing grooves 64 formed in the hammer 20 forward of the notch 54 if the safety interlock push button 56 is not depressed, thereby negating retraction of the actuation grip 18 when the actuation grip 18 and the hammer 20 are mated. The safety interlock push button 56 must be fully depressed to release the "dog" 62 from the hammer 20 and allow the hammer 20 to be fully retracted by the user during a launching sequence. If pressure on the safety interlock push button 56 is lost during the actuation grip 18 being retracted, the interlock protrusion "dog" 62 will drop into another one of the grooves 64 in the hammer 20 and cease further retraction of the hammer 20. To further provide operator safety, if the safety interlock 26 is released after partial actuation grip/hammer retraction, the hammer 20 driven actuation pins 22 cannot accidentally fire into the payload cartridge 14 due to hammer 20 and actuation grip 18 being mated and the retaining tabs of the actuation grip 18 being stopped by the inside wall of the housing assembly rear grip 34. The safety interlock 26 is preferably injection molded of a suitable plastic material.

For a successful hammer 20 release to initiate a payload launch, the safety interlock 26 must be maintained in a depressed state while the actuation grip 18 is fully retracted. The actuation grip detent sear 38 is depressed by being driven downward and out of the hammer detent sear receiver hole by the release member 24 that runs in the slot 44 of the hammer 20 that bifurcates the detent sear receiver hole. This instantaneously disengages the hammer 20 from the actuation grip 18. Only then can the hammer 20 generate enough forward travel to drive the actuation pins 22 into the payload cartridge 14 to initiate a payload launch. Upon release of pressure on the safety interlock push button 56 and the actuation grip 18, the safety interlock compression spring 58 biases the hammer 20 rearward and the spring-biased actuation grip 18 moves forward to re-engage the detent sear 38 with the hammer 20 and resets the reusable launcher 12 into a "fire" ready condition.

Through experimentation it has been discovered that novice operators attempt to launch a relatively short-length launcher by placing their non-dominant hand on the forward section of the launcher or the payload cartridge. Unfortunately, if the hand is placed in front of the payload cartridge, upon launch the hand could impede the payload from being deployed correctly or even possibly cause injury due to the rapid nature of the payload ejecting from the payload cartridge. The present design negates the potential for this to occur by providing the front grip 35 and ensuring that the user's non-dominant hand remains on the front grip 35 until the launch is complete by requiring the safety interlock push button 56, which located at the front grip 35, to remain depressed. This also improves launcher recoil control by the operator upon moment of launch, thereby improving accuracy of the launched payload to the intended target.

As best shown in FIG. 3, the illustrated latch assembly 28 has a slider 66 secured to the top of the housing assembly 16 near a forward end of the housing assembly 16. The slider 66 is spring biased in the forward direction and can be selectively slid in the rearward direction against the spring bias by the user. A latch pin or detent 68 forwardly extends from the slider 66 and moves with the slider 66 between a forward position in which the detent 68 engages the payload cartridge 14 to prevent vertical installation or removal of the payload cartridge 14 as described in more detail hereinafter and a rearward position in which the detent 68 does not prevent vertical installation or removal of the payload cartridge 14 to the reusable launcher 12. It is noted that any other suitable type of latch assembly 28 can alternatively be utilized. The forward end of the illustrated housing assembly 16 is also provided with a maleT-rail 70 for removable attachment of the payload cartridge 14 to the reusable launcher 12. It is noted that any other suitable type of removable connection can alternatively be utilized between the reusable launcher 12 and the payload cartridge 14.

Figure 10:
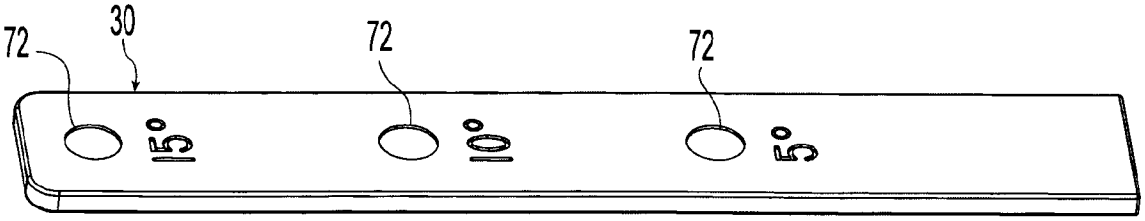
FIG. 10 is a perspective view of a sight blade of the launcher of the rescue launcher system of FIGS. 1 to 3.

As best shown in FIGS. 2 and 10, the rear sight 30 is pivotably secured to the top of the housing assembly 16 near the rear end housing assembly 16 so that the rear sight 30 is pivotable between a vertical and upwardly extending usage position (shown in broken line in FIG. 2) and a horizontal and forwardly extending storage position (shown in solid line in FIG. 2). The illustrated housing assembly 16 has a detent which is upwardly biased by a compression spring that engages a recess in a bottom of the base of the rear sight 30 so that the rear sight 30 can be maintained in its usage position during use but can be easily pushed to its storage position when desired. The illustrated rear sight 30 is provided with a plurality of vertically spaced apart openings or transparent portions 72 which are used in cooperation with a front sight 74 located on the payload cartridge 14 for orienting the rescue launcher system 10 at a desired angle. The illustrated rear sight 30 is adapted for 5, 10 and 15 degree angles but any other suitable angles and/or quantity of angles can alternatively be utilized. It is noted that any other suitable type of rear sight 30 can alternatively be utilized.

Figure 11:
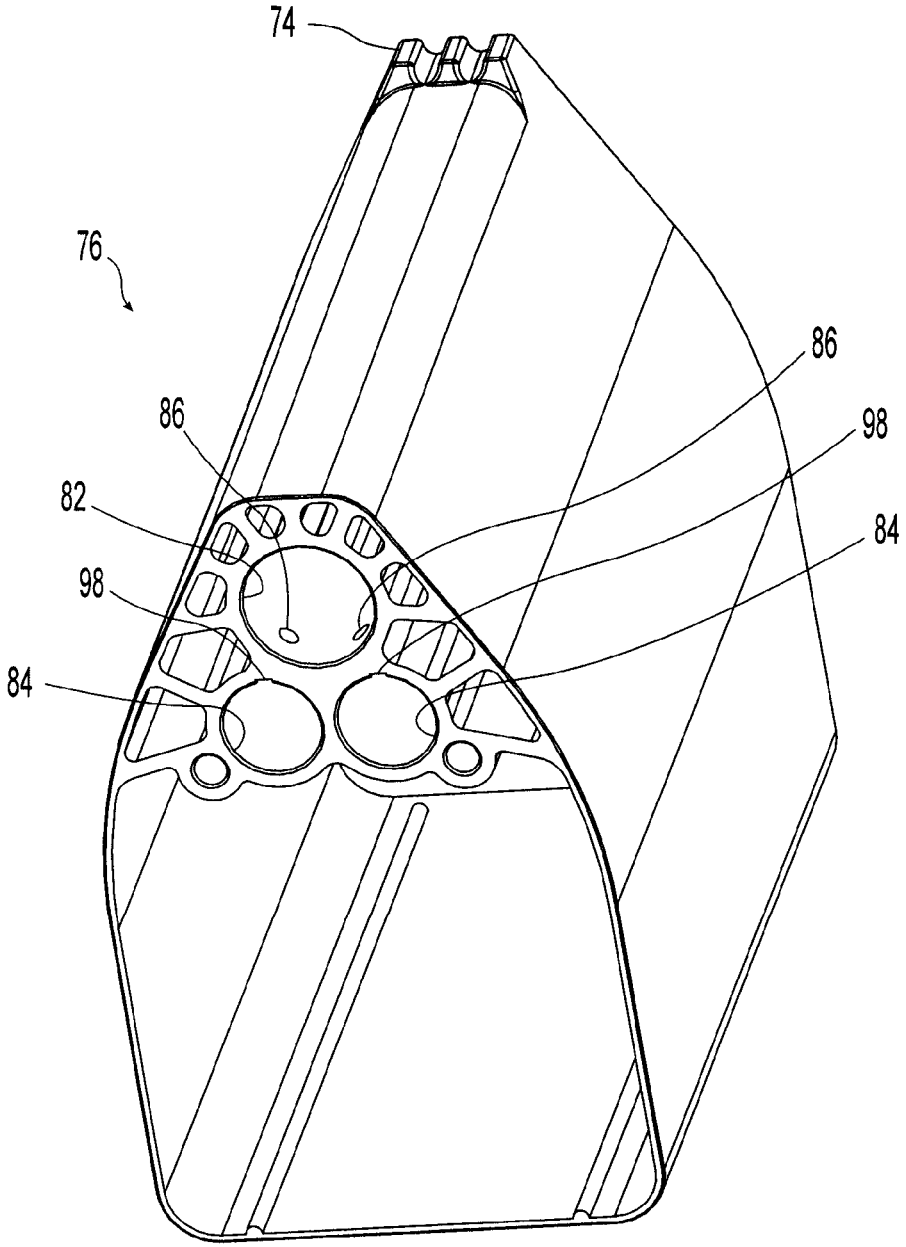
FIG. 11 is a perspective view of a canister of the payload cartridge of the rescue launcher system of FIGS. 1 to 3.

As best shown in FIGS. 1, 3, and 11, the one-time-use, pre-packed payload cartridge includes a high strength polymer injection molded or extruded housing or canister 76 in which a variety of payloads can be positioned for specific missions. It is envisioned that the canister 76 can contain multiple payload variations. The illustrated canister 76 is of a one piece molded construction having a top portion or section containing a payload towing projectile 78 and the pressurization and actuation system 32 for launching the payload towing projectile 78, and a lower portion or section containing a payload 80. This one piece design is universal for different types of payloads 80 but it is noted that alternatively a two-piece design can be utilized to provide the ideal shape and space for a specific payload, and potentially economize on polymer material. Volume of manufacture would determine the most cost effective method either utilizing a universal one piece design or molding multiple shapes and sizes of lower sections and joining the two pieces together.

The illustrated canister 76 has a relatively thin exterior wall and forwardly extending launch tube 82 therein which is open at each end and is sized and shaped for receiving the payload towing projectile 78 therein. The launch tube 82 can be utilized as molded or can have a thin metal tube pressed therein if it is determined that launch pressure may exceed operational strength of the polymer. The illustrated launch tube 82 is supported in the outer wall by ribbing to minimize polymer material usage and to further provide operator safety by isolating the "pressurized on launch" tube from the outer wall in case of a catastrophic failure of the launch tube 82 by utilizing the ribbing as a potential crimping zone.

The illustrated canister 76 also has a pair of laterally spaced-apart pressurization tubes 84 located below and contiguous with the launch tube 82. The illustrated pressurization tubes 84 extend in the forward direction and are open at each end and are sized and shaped for receiving the pressurization and actuation system 32 as describe in more detail hereinbelow. A gas port or passage 86 is drilled between the launch tube 82 and each of the pressurization tubes 84 at the rear end of the tubes 82, 84 to permit passage of pressurized gas from the pressurization tubes 84 to the launch tube 82 as described in more detail hereinafter. The illustrated pressurization tubes 84 are each supported within the outer wall by ribbing to minimize polymer material usage.

Figure 15:
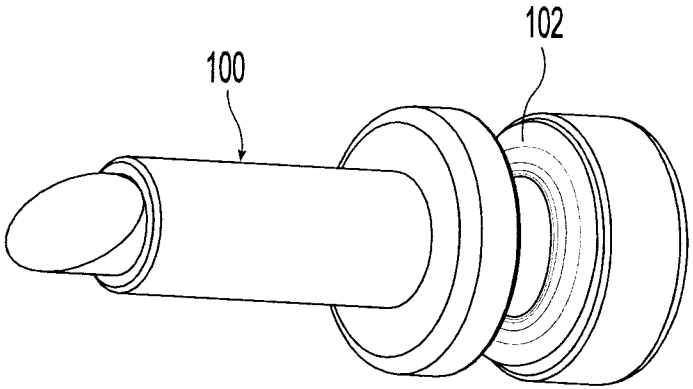
FIG. 15 is a perspective view of a pierce pin of the payload cartridge of the rescue launcher system of FIGS. 1 to 3.
Figure 14:
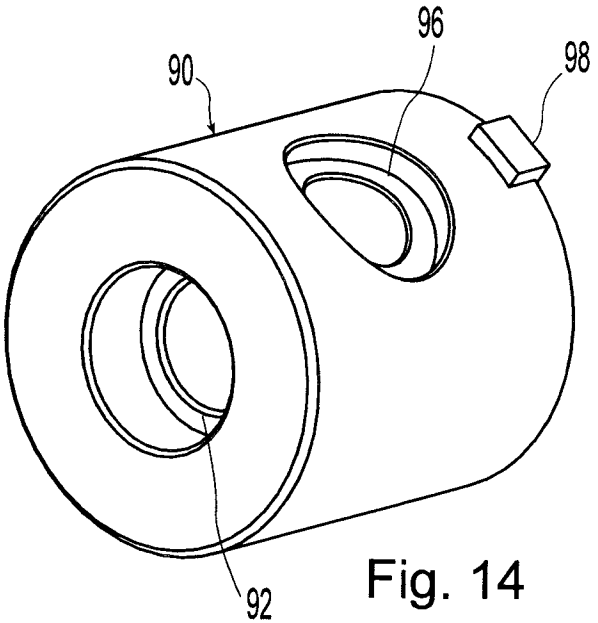
FIG. 14 is a perspective view of a gas cylinder cap of the payload cartridge of the rescue launcher system of FIGS. 1 to 3.

As best shown in FIGS. 3, 14, and 15, the illustrated pressurization system 32 includes pre-pressurized gas cylinders or cartridges 88. Suitable pre-pressurized gas cylinders 88 are available from Leland Limited (Bedminster, N.J.) 2700 psi nitrogen cylinders, part number 42101N22700 but any other suitable pre-pressurized gas cylinders can be utilized. Gas cylinder caps 90 are provided in the pressurization tubes 84 at the rear or "firing end" the gas cylinders 88. A forward end of the illustrated gas cylinder cap 90 is provided with a forward-facing opening or bore for receiving the gas cylinder 88 and is provided with an elastomeric face seal 92 to provide a gas-tight seal therebetween. The "firing end" of the pre-pressurized gas cylinders 88 are maintained in tension against the elastomeric face seal 92 in the gas cylinder cap by a internal "rotor clip" retaining ring 94 such as, for example, ones sold by McMaster-Carr Supply Co., part number 98435A152. It is noted, however, that the gas cylinders 88 can alternatively be tensioned by any other suitable means. An upper end of the illustrated gas cylinder cap 90 is provided with an upward-facing opening or bore for cooperating with the gas port 86 to the launch tube 82 and is provided with an elastomeric seal 96 to provide a gas-tight seal therebetween. The illustrated gas cylinder caps 90 have concentric grooves formed into the outer perimeter of the gas cylinder cap 90 in relationship to perpendicular gas passages to provide space for the elastomeric seal 96 to contain pressure between the gas cylinder cap 90 and the launch tube gas port 86. The illustrated gas cylinder caps 90 are keyed 98 in relationship with pressurization tubes 84 in order to ensure alignment with the gas ports 86. The gas cylinder caps 90 are each preferably injection molded of a suitable plastic material.

Spring-biased gas cylinder puncture or pierce pins 100 are housed axially parallel to the pressurization tubes 84 in the gas cylinder caps 90. The illustrated gas cylinder puncture pins 100 have circumferential elastomeric seals 102 that seal the outside diameter of the puncture pins 100 to the inside diameter of the gas cylinder caps 90 to maintain gas tightness upon firing of the rescue launcher system 10. The puncture pins 100 are spring biased rearward toward a rear canister cap 104 and maintained in position by the rear canister cap 104. The illustrated rear canister cap 104 has actuation port holes 112 concentric to the gas cylinder caps 90 that are smaller diameter than the puncture pins 100, thereby the puncture pins 100 are maintained in a battery position once the payload cartridge 14 is assembled. The forward end of the puncture pins 100 are adapted to pierce the gas cylinders 88 when the puncture pins 100 are engaged and driven forward by the actuation pins 22 of the reusable launcher 12. While the illustrated embodiment includes two gas cylinders 88, it is noted that one, two, or more of the gas cylinders 88 can be utilized. Power demands of the payload 80 to be launched would determine the number of gas cylinders 88 to be installed. It is also noted that the pressurization and actuation system 32 can alternatively be of any other suitable type such as for example, gunpowder actuated gas generation canister can replace the pre-pressurized gas cylinders 88 while firing pins replace the puncture pins 100.

Figure 12:
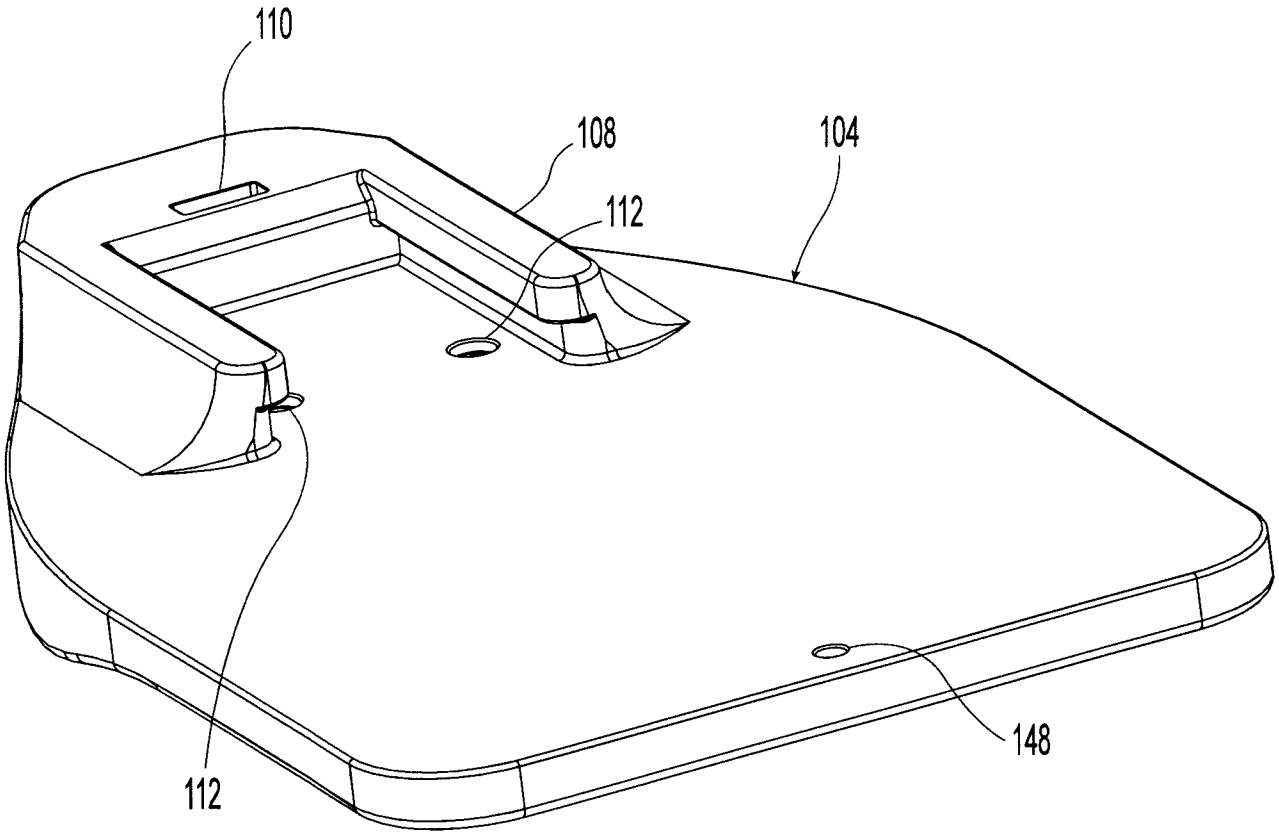
FIG. 12 is a rear perspective view of a canister cap of the payload cartridge of the rescue launcher system of FIGS. 1 to 3.
Figure 13:
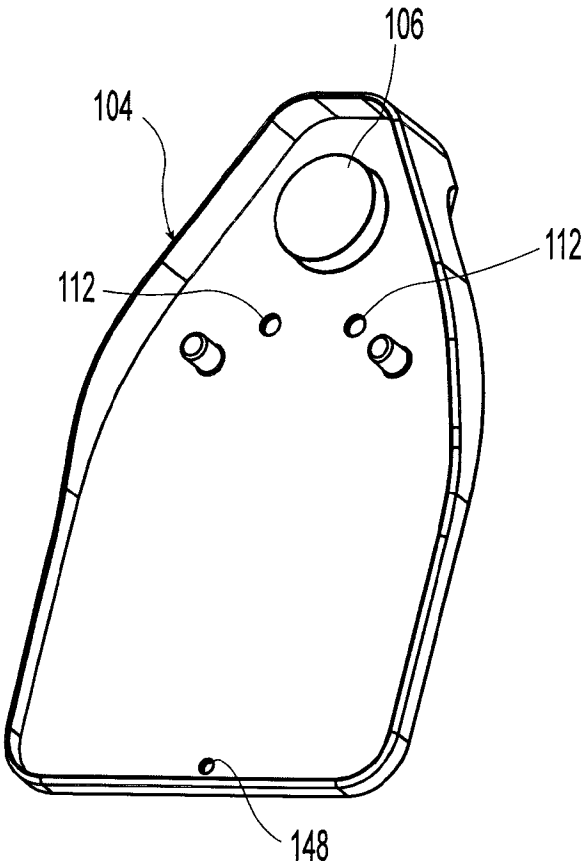
FIG. 13 is a front perspective view of the canister cap of FIG. 12.

As best shown in FIGS. 3, 12, and 13, the rear end of the illustrated canister 76 is closed by the rear canister cap 104. The illustrated rear canister cap 104 is secured to the canister by a pair of forwardly facing attachment pins that are received into rearwardly facing attachment openings in the canister. The illustrated rear canister cap 104 is additionally either solvent bonded or high strength glued to the rear of the canister 76. It is noted however, that the rear canister cap 104 can alternatively be secured to the canister 76 in any other suitable manner. The illustrated rear canister cap 104 performs several functions other than closing off the rear of the canister 76. First, the illustrated rear canister cap 104 maintains the puncture pins 100 in their "battery" position. Second, the illustrated rear canister cap 104 is provided with a forward facing plug 106 sized and shaped for gas-tight plugging the rear end of the launch tube 82. Third, the illustrated rear canister cap 104 is provided with a female T-rail 108 for cooperation with the male T-rail 70 of the reusable launcher 12 and a latch opening 110 for cooperation with the detent 68 of the latch assembly 28 of the reusable launcher 12. Thus, the payload cartridge 14 can be easily and quickly secured to the reusable launcher 12 by sliding the female T-rail 108 downwardly onto the male T-rail 70 of the reusable launcher 12 which retracts the latch detent 68 and then allows the latch detent 68 to resiliently enter the detent opening 110 due to the spring bias to prevent unintended disengagement of the T-rail connection. The payload cartridge 14 can also be easily and quickly removed from the reusable launcher 12 by sliding the latch detent 68 rearwardly out of the detent opening 110 and then sliding the female T-rail 108 upwardly off of the male T-rail 70. Finally, the illustrated rear canister cap 104 aligns the actuation pins 22 of the reusable launcher 12 with the puncture pins 100 of the payload cartridge 14 and is provided with actuation ports 112 so that the actuation pins 22 can engage the puncture pins 100. The rear canister cap 104 is preferably injection molded of a suitable plastic material.

As best shown in FIGS. 1 and 3, a breakaway front canister lid 114 is installed on the front end of the canister 76 to protect the payload 80 from handling damage. The illustrated front canister lid 114 is secured to the canister 76 with strategically positioned glue points that breakaway as the launched towing projectile 78 moves forward in the canister 76 and impinges on the inside surface of the front canister lid 114. It is noted however, that the front canister lid 114 can be alternatively secured to the canister 76 in any other suitable manner. The illustrated front canister lid 114 is designed to fit inside the canister 76 upon steps that are slightly offset from the front of the launch tube 82 to allow clearance for a flexible line attached between the towing projectile 78 and the payload 80 to enter the lower section of the canister 76 from the top section of the canister for attachment to the payload 80. The illustrated front canister lid 114 has a relatively smooth inner surface so as not to create a "lip" that may tangle or impede exiting payloads 80. The front canister lid 114 simply falls to the ground upon launch actuation once the launched towing projectile 78 and/or the payload 80 impacts it. Alternatively, the lower portion of the front canister lid 114 can be secured to the bottom of the canister 76 with a spring loaded hinge which can be formed by high strength tape, such as, for example, 3M VHB™ (very high bond), backed with a thin sheet of flexible plastic. For example, this could be utilized if the payload 80 is an animal capture net as deployment of a net requires back tension on the netting material to "pay" out the net fabric and eliminate tangling. The front canister lid 114 is preferably injection molded of a suitable plastic material.

It is envisioned that the polymers utilized in the disposable payload cartridge 14 can be recyclable or manufactured from biodegradable materials to minimize environmental impact. A large adhesive label pictographically describing the operational instructions in reference to the specific payload 80 packed in the payload cartridge 14 can be applied to the exterior of the canister 76. Alternatively these operational directions can be screen or pad printed directly on the canister 76.

Figure 16:
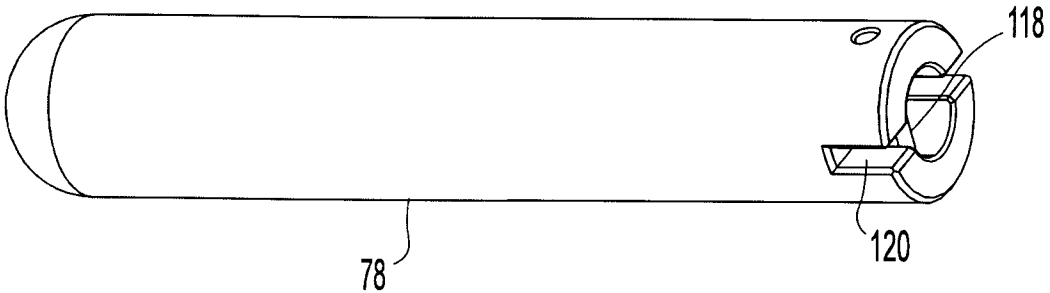
FIG. 16 is a perspective view of a towing projectile of the payload cartridge of the rescue launcher system of FIGS. 1 to 3.

As best shown in FIGS. 3 and 16, the illustrated towing projectile 78 is generally cylindrical shaped and sized and shaped to closely fit within the launch tube 82. The rearward end of the illustrated towing projectile 78 is provided with a transverse opening for receiving a line attachment cross pin 118. The illustrated rear end of the towing projectile 78 also includes a rearward facing slot 120 which is perpendicular to the cross pin 118. The side of the illustrated towing projectile 78 is provided with a longitudinally-extending clearance side slot 122 so that the line 116 can be looped around and terminated at the center of the cross pin 118, extend from the line cross pin 118 through the rearward facing slot 120 to the side slot 122, and through to side slot 122 to the front of the canister 76 where the line 116 extends down to the front of the payload 80 to be towed. The illustrated rearward end of the towing projectile 78 also is provided with a rearward facing bore for receiving a weighting bar as needed to weight and balance the towing projectile 78. The forward end of the towing projectile can be provided with a forward facing bore for insertion of a miniature chemical light stick which is activated upon impact with the front canister lid 114 and can be useful for rescues during low light conditions. The towing projectile 78 is preferably injection molded of a suitable plastic material.

As best shown in FIGS. 3 and 17 to 24, the illustrated payload 80 is a flotation payload having a foam buoyancy device 124 for water rescues but it is noted that any other suitable type of payload 80 can alternatively be utilized. The illustrated flotation payload 80 inflates the buoyancy device 124 utilizing a mechanical method and is an alternative to a launched CO2 inflated buoyancy device such as deployed by the ResQmax™ launcher. This mechanical method offers a simple cost effective alternative to known CO2 inflated buoyancy devices.

Through trials & experimentation, several key operational & technical issues have been discovered with CO2 inflated buoyancy systems. First, the bobbin style CO2 self inflators have a limited shelf life without servicing due to the moisture sensitive soluble bobbin. Research has uncovered instances where there was premature discharge and filling of flotation devices utilizing these inflators when stored in high humidity locations; e.g. shipboard, near bodies of water; due to bobbin deterioration. This bobbin servicing requirement negates this type of inflation system from long storage necessary for a one-time use emergency rescue device. Second, it is impossible to get an auto-inflator utilizing a soluble bobbin firing system to actuate automatically in an ice rescue situation due to the necessity of a soluble bobbin auto inflator to be fully immersed in water to actuate. Therefore this rescue scenario would require manual inflation actuation. It would be very difficult to get a panicking rescue subject clinging to an ice hole to manually actuate a flotation device. Third, the ideal launched payload is one with minimal weight. For equivalent distances, lower projectile weight requires less launch power, minimizes subsequent recoil from launch, and lessens injury potential from an accidental strike of the rescue subject. An average auto-inflating CO2 mechanism alone weighs approximately 8 oz. without the flotation device or launch canister. A CO2 inflation system requires considerably more power to launch a buoyantly equivalent device than a mechanically activated flotation system the same distance based on initial weight. Fourth, the physical size of the packed auto inflator, CO2 gas cylinder, and relatively inflexible flotation device fabric able to withstand rapid inflation pressure creates packing difficulty for a payload to be compact enough for a manageable launched payload. Fifth, the complexity and resultant cost of the CO2 auto inflator system and associated pressure resistant flotation device creates a relatively high cost for an envisioned emergency one-time use launched flotation device.

Figure 18:
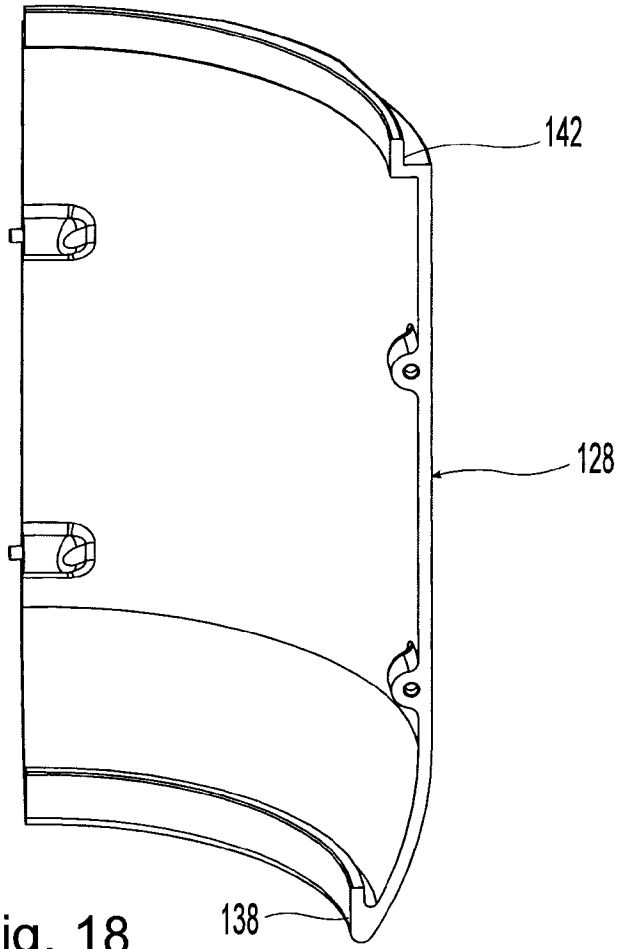
FIG. 18 is a perspective view of a shell segment the flotation payload assembly of FIG. 16.
Figure 17:
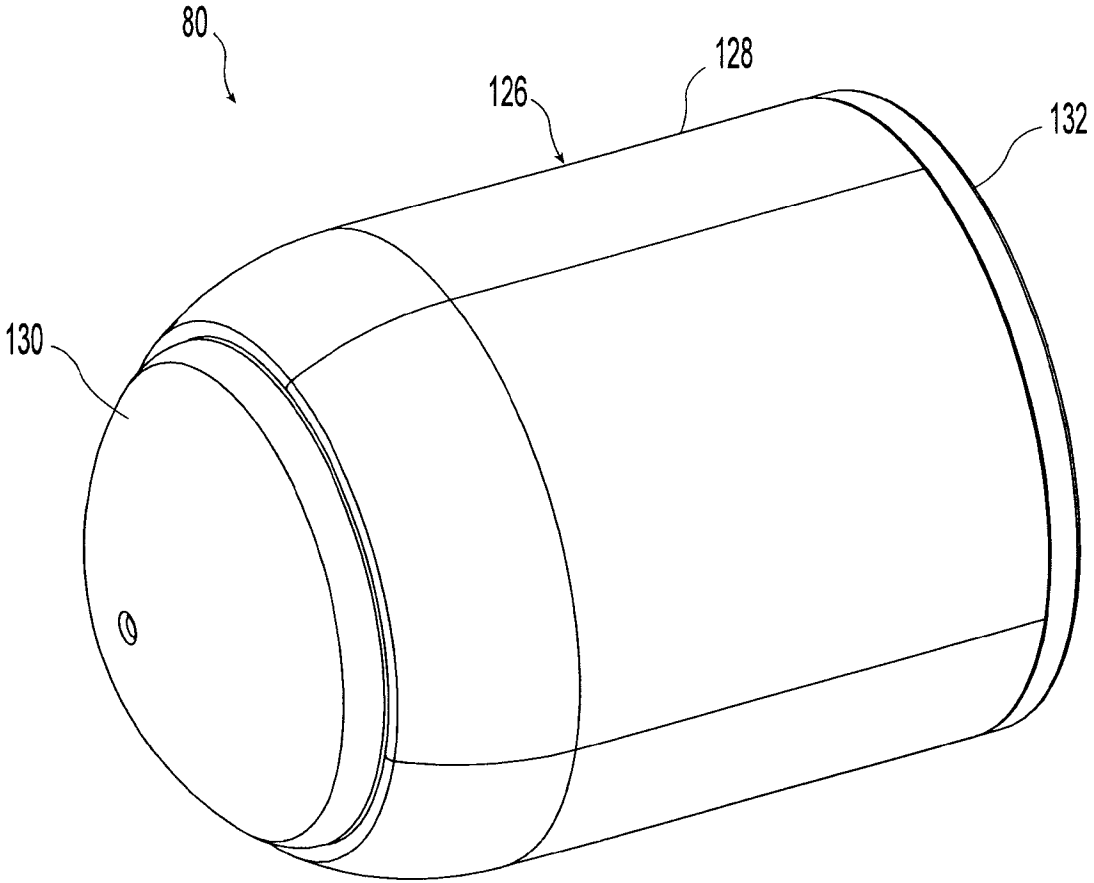
FIG. 17 is a perspective view of a flotation payload assembly of the payload cartridge of the rescue launcher system of FIGS. 1 to 3.
Figure 19:
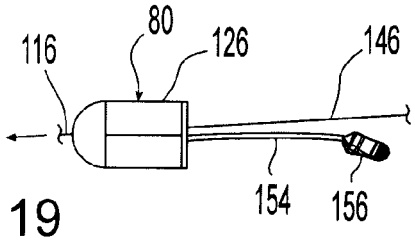
FIG. 19 is a diagrammatic view of the flotation payload assembly of FIG. 16 as it travels through the air.

As best shown in FIGS. 3, 17, and 18, the illustrated flotation payload 80 includes a shell assembly 126 including a plurality of shell segments 128 forming an outer periphery with open ends, a front release cap 130 which closes the front open end of the shell segments 128, and a rear cap 132 which closes the rear open end of the shell segments 128. The components 128, 130, 132 of the shell assembly 128 are each preferably injection molded of a suitable plastic material. The illustrated shell assembly 126 utilizes four of the shell segments 128 but it is noted that any other suitable quantity of the shell segments 128 can alternatively be utilized. The illustrated front release cap 130 is provided with a central opening for passage of the line 116 from the towing projectile 78. The line 116 is preferably terminated behind a foam fronted washer 134 to minimize launch shock. The illustrated front release cap 130 is provided with a peripheral flange 136 which is located within the shell segments 128 and behind a front flange 138 of the shell segments 128. This interface between the front release cap 130 and the shells segments 128 enables the shell assembly 126 to remain together while being towed by the line 116 but break up or open when the front release cap 130 impacts the target to move the front release cap 130 rearwardly relative to the shell segments 128 to release the shell segments 128 from the front release cap 130. The illustrated rear cap 132 is provided with a peripheral flange 140 which extends about and radially into a rear flange 142 of the shell segments 128 to form a hinge-like connection so that the shell segments 128 pivot outwardly about their rear ends when released from the front release cap 130 upon impact. The illustrated rear cap 132 is provided with a central opening 144 for passage of a tow or tether line 146 therethrough which is secured to the buoyancy device 124 which is located within the shell assembly 126. The illustrated tow line 146 is packed within the canister 76 behind the shell assembly 126 and extends out of the canister 76 through an opening 148 in the bottom of the rear canister cap 104. It is noted that the payload 80 can alternatively have any other suitable configuration.

FIGS. 20 to 24 show the illustrated buoyancy device 124. The mission of the illustrated buoyancy device 124 is not to provide a rescue subject with a buoyancy device designed to keep them afloat for a considerable time, but rather only to provide added buoyancy long enough to initiate an emergency rescue via the tow line 146 tethered to the buoyancy device 124. It is noted that this buoyancy device 124 is not a substitute for a worn personal flotation device (PFD), but is rather a very short term use buoyancy aid, so therefore doesn't demand the rigorous high buoyancy and extreme long term durability requirements of a conventional PFD. It is envisioned that a low-cost, one-time use compact mechanically air filled buoyancy device 124 can be manufactured as described hereinafter. It is noted that while one shape and version of the buoyancy device 124 is described in detail, many other different sizes and shapes will be apparent to one of skill in the art for use in various applications.

Figure 22:
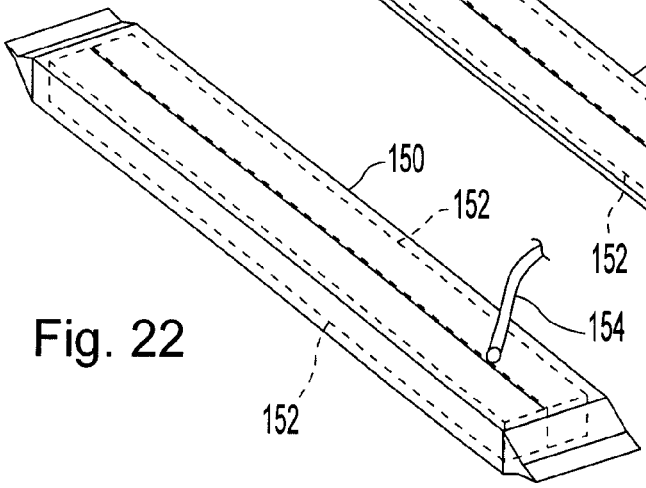
FIG. 22 is a diagrammatic view of a foam member of the flotation member of FIG. 21; wherein the foam member is inflated.
Figure 23:
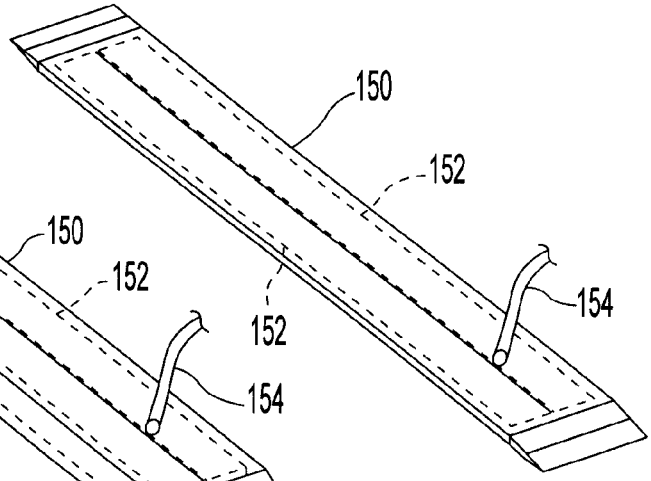
FIG. 23 is a diagrammatic view of a foam member of the flotation member of FIG. 21; wherein the foam member is deflated.

As best shown in FIGS. 22 and 23, the core of the illustrated buoyancy device 124 is a length of thin wall flexible, non-permeable plastic tube 150 maintained "open" by open cell soft foam 152 in the form of blocks or strips provided therein. The plastic tube 150 can be, for example, a polyethylene-type material used as bag packaging that is sold in continuous rolls. One example of a product used in concept prototypes is item # T010-00039-002 Foodsaver Vacuum Packaging Bags sold in an 8" wide continuous roll. This plastic tube is sold flat, cut to length, and heat sealed shut at each end to create a closed bag. In the Foodsaver technology, this company makes a vacuum sealing system whereas one end of the bag is heat sealed, product for storage is introduced through the open end, and then a vacuum is pulled on the open end expelling most of the air, and while the vacuum is maintained, the bag is heat sealed at the other end. It is also envisioned that more durable fiber reinforced tube could be utilized for higher strength requirements. The core of the illustrated buoyancy device 124 can be manufactured utilizing the basic concept of this vacuum sealing technology, or simply compressing and evacuating air out of the foam filled non-permeable plastic tube 150 via mechanical compression methods.

The buoyancy device 124 can comprise the plastic tube 150 with a width of, for example, about 8" and two strips of open cell soft urethane foam 152 having a width and height each of, for example, about 2.25" for a total rectangular cross section of 2.25"×4.5", or a cross-sectional area of about 10.12 square inches. The two strips of foam 152 can have a length of, for example, about 42" long. These exemplary strips of foam 152 provide a volume of about 425 cubic inches. Considering the foam 152 is waterproofed by being inserted in the plastic tube 150, in the "actuated" or expanded "at rest" form, the foam 152 would displace approximately 1.84 gallons of water, or an approximate positive buoyancy of 15.3 lbs in 70° F. fresh water, which is sufficient for an emergency buoyancy device 124 for rapid extraction from water. It is noted that the foam 152 can alternatively have any other suitable size.

A length of small diameter flexible plastic tubing 154 pierces and is sealed to the plastic tube 150. The plastic tubing 154 can have an inside diameter of, for example, about 0.19". The plastic tubing 154 can be sealed to the plastic tube 150 in any suitable manner. The other end of the plastic tubing 154 is affixed to an air-intake float assembly 156 so that the air-intake float assembly 156 is in air-flow communication with the interior of the sealed plastic tube 150.

Figure 24:
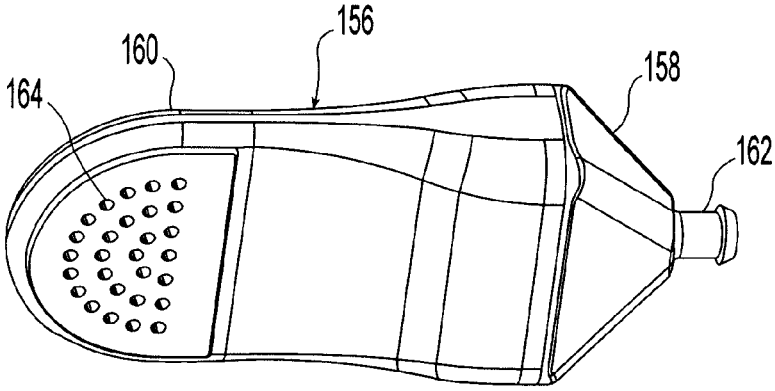
FIG. 24 is a perspective view of a float assembly of the flotation device of FIG. 20.

As best shown in FIG. 24, the illustrated float assembly 156 includes a bottom portion 158 and a top portion 160 which are secured together to form an interior cavity. The illustrated bottom and top portions 158, 160 are sized and shaped so that the float assembly 156 generally stays upright when floating in water. That is, the top portion 160 of the float assembly tends to stay above water level when the float assembly 156 is floating in water. The bottom and top portions 158, 160 are each preferably injection molded of a suitable plastic material. The illustrated bottom portion 158 is provided with an outlet 162 to which the plastic tubing 154 is secured to communicate the float assembly 156 with the interior of the plastic tube 150. The illustrated outlet 162 is provided with an inexpensive low cracking pressure, one-way cartridge check valve. Alternatively or additionally as a safety back-up, the check valve can be provided in the connecting plastic tubing 154. A suitable check valve is available from Smart Products Inc., Morgan Hill, Calif., part number 110 or 111. The check valve or valves are oriented so that the free flow direction is out of the float assembly 156 and into the plastic tube 150 containing the foam and the "checked" or blocked flow direction is out of the plastic tube 150 and into the float assembly 156. The illustrated top portion 160 is provided with inlets 164 on opposed sides of the top portion 160. The illustrated inlets 164 are in the form of caps having multiple holes therein for intrusion of air into the float assembly 156. The illustrated inlets 164 are provided with hydrophobic filter sheets which allow air flow in, but block any inflow of water. These sheets are retained in the float assembly 156 by the protective caps or covers 164. An example of a suitable hydrophobic filter material is MFPTFE02550B 5 micron which is available from Membrane Solutions of Plano, Tex. Constructed in this manner, the float assembly 156 allows only air, and not water, to flow into the foam containing plastic tube 150 upon foam expansion, while negating any air from escaping once the foam totally expands and fills the foam containing plastic tube 150 with air. It is noted that the float assembly 156 can also be utilized as a back-up oral inflation port in cases where total inflation does not occur. The rescue subject would be instructed to place the top end of the flotation assembly into their mouth and to blow to use lung pressure to inflate the plastic tube 150 and the foam 152 therein rather than or in addition to the foam 152 creating a vacuum to draw air in. It is noted that alternatively a separate check-valved oral inflation tube can be provided if desired.

The illustrated core of the buoyancy device 124 can be manufactured by inserting the open cell foam 152 into the plastic tube 150 and sealing both ends of the plastic tube 150. A vacuum system could be utilized to pull the air out of the foam containing plastic tube 150 through the attached plastic tubing 154, including all air out of the open cell soft foam 152. The plastic tubing 154 would then be temporarily clamped shut prior to being packed in the shell assembly 126 while being mechanically restrained in its compressed form. An alternative method would be to use mechanical compression to squeeze the air out of the foam 152 and the foam containing plastic tube 150 through the attached plastic tubing 154 prior to installation of the check valve(s) and/or the float assembly 156. The removal of air will reduce the thickness of the illustrated plastic tube 150 including the foam 152 "at rest" from about 2.25" thickness to about 0.25" which is a thickness reduction of nearly 90%. Once vacuumed or otherwise air evacuated, the buoyancy device 124 is inserted into the shell assembly 126 where it is mechanically restrained in its compressed or deflated form with the tow line 146 and the tubing 154 extending through the opening 144 so that the float assembly 156 is located outside the shell assembly 126. The buoyancy device can be folded or rolled to create a compact size to tightly fit in the shell assembly 126. Once the buoyancy device 124 is packed and restrained in the shell assembly 126, the check valve(s) and/or float assembly 156 are attached to the plastic tubing 154.

Figure 20:
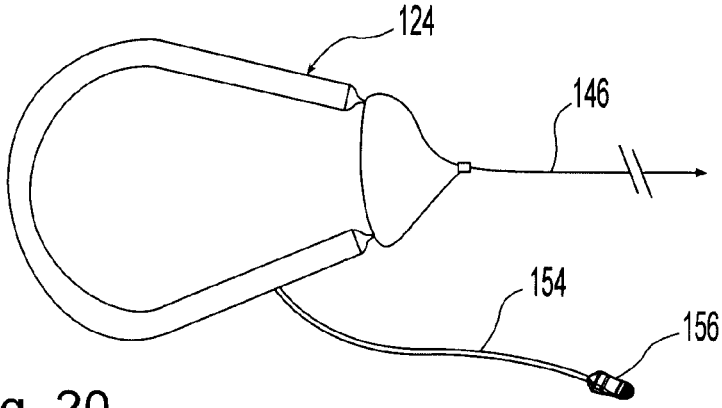
FIG. 20 is a diagrammatic view of a flotation device of the flotation payload assembly of FIG. 16.
Figure 21:
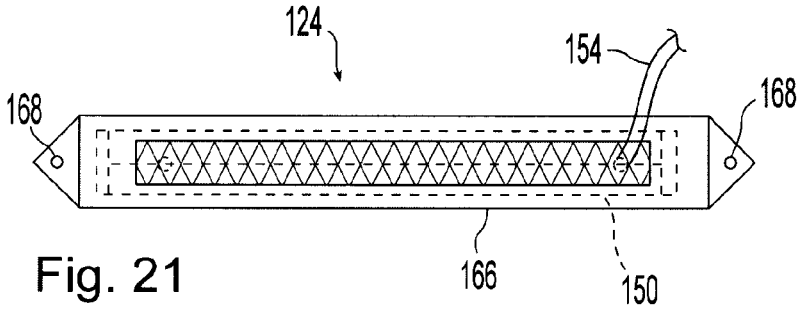
FIG. 21 is a diagrammatic view of a flotation member of the flotation device of FIG. 20.

As best shown in FIG. 21, the core of the buoyancy device 124 can be inserted into a fabric or mesh sleeve 166 that allows for the resultant expanded dimensions upon actuation. The sleeve 166 protects the plastic tube 150 from puncture and has grommets and/or other attachment points 168 for the tow line 146 for towing by the rescue operator. As best shown in FIG. 20, the illustrated tow line 146 is secured to the sleeve to form a "horse collar" shaped loop of the buoyancy device 124 for grasping by, or wrapping around a rescue subject. It is also envisioned that the plastic tube 150 could be constructed of a finer reinforced material or the like that would negate the need for the fabric sleeve 166 and allow direct grommet connection to the plastic tube 150. The sleeve fabric 166 and/or the plastic tube 150 can be constructed of a highly visible color and/or have additional phosphorescent or light reflecting material attached as a visual aid for the rescue subject and the rescuer to locate the rescue subject.

In deployment, once the buoyancy device 124 is ejected from the shell assembly 126 so that it is no longer mechanically restrained in its compressed form, the foam 152 immediately starts expanding as air is drawn in through the hydrophobic filters and check valve of the float assembly 156 and into the plastic tube 150 containing the compressed deflated foam 152. Upon water impact, the buoyancy device 124 is minimally buoyant and the air-intake float assembly 156 trailing on the attached plastic tubing 154 maintains the inlets 164 out of the water and the hydrophobic filters restrict water from entering the foam containing plastic tube 150 but allow air to enter. Utilizing low permanent set foam, the foam and subsequently the foam containing plastic tube should return to at least 75% of original expanded size within a few seconds even with long term deflated or compressed storage. If the foam containing plastic tube 150 is grasped and squeezed, air pulled into it by the action of the expanding foam 152 is trapped by the one-way check valves and provides positive buoyancy for the rescue subject.

In addition to use of this aforementioned foam buoyancy device 124, the disclosed mechanically inflated foam 152 can be utilized with "wearable" or a hand thrown low cost emergency buoyancy devices. This mechanically inflated foam 152 can be inexpensively built into jackets or other clothing to provide emergency flotation by employing removable shaped foam blocks inserted in the non-permeable plastic tubing or film bags. A "ripcord" or other type of actuation can simultaneously release the plastic tubing 154 tethering the air-intake float assembly 156 and remove an inexpensive tubing pinch clamp that maintains the plastic tubing 154 in a "compressed and closed to atmosphere" state. Suitable tubing clamps are known in the art such as medical tubing clamps. An example of such a clamp that may be adapted for this use is part number M2921900 manufactured by B. Braun Medical Inc. of Bethlehem, Pa. Upon actuation, the mechanical inflation would occur as previously described and offer emergency buoyancy aid to the wearer until he could be extracted from the situation. Forms of internal pockets could house the buoyancy devices with movable flaps, so that the buoyancy devices can be easily removed for garment cleaning and then reinstalled. As noted above, the float assembly 156 can also be utilized as a back-up oral inflation port in cases where total inflation does not occur. The rescue subject would be instructed to place the top end of the flotation assembly into their mouth and to blow to use lung pressure to inflate the tube 150 and the foam 152 therein rather than or in addition to the foam 152 creating a vacuum to draw air in. It is noted that alternatively a separate oral inflation tube can be provided if desired.

During operation of the illustrated rescue launcher system 10 for a water rescue, the user grasps the rear grip 34 with one hand and grasps the front grip 35 with the other hand near the safety interlock push button 56. The user then lines up the subject in the sights 30, 74, depresses the safety interlock push button 56 with one hand and squeezes the actuation grip 18 with the other hand. As the actuation grip 18 moves rearwardly, the hammer 20 moves rearwardly therewith until the detent sear 38 engages the release member 24 to downwardly deflect the detent sear 38 and release the hammer 20 from the actuation grip 18. It is noted that if the safety interlock push button 56 is released at any time prior to the hammer 20 being released from the actuation grip 18, the safety interlock 26 will engage the hammer 20 to prevent further rearward movement of the actuation grip 18 and the hammer 20 attached thereto. With the hammer 20 released from the actuation grip 18, the compression springs 48 forwardly propel the hammer 20 so that the actuation pins 22 move forwardly out of the housing assembly 16 and engage the puncture pins 100 in the attached payload cartridge 14. The puncture pins 100 move forward and pierce the gas cylinders 88 to rapidly release the pre-pressurized gas from the gas cylinders 88. Gas rapidly travels through the gas ports 86 to the launch tube 82 behind the towing projectile 78 and forwardly propels the towing projectile 78 out of the launch tube 82. As the towing projectile 78 exits the launch tube 82, it engages the front canister lid 114 of the canister 76 which is removed from the canister 76 by the impact. When the line 116 connecting the towing projectile 78 to the payload 80 becomes taught, the towing projectile 78 pulls the payload 80 from the canister 76 and pulls it through the air. The traveling shell assembly 126 pulls the float assembly 156 and the tow line 146 there behind (best shown in FIG. 19). When the shell assembly 126 of the payload 80 contacts the water or other surface by the rescue subject, the front release cap 130 of the shell assembly 126 is displaced by the impact and the shell segments 128 fall apart so that the foam buoyancy device 124 is ejected and becomes unfolded. The foam 152 within the buoyancy device 124 immediately starts expanding as air is drawn in through the air-intake float assembly 156 to inflate the compressed foam containing plastic tube 150 as the foam 152 expands to its uncompressed state. The rescue subject can gasp the buoyancy device 124 to remain afloat as the rescuers pull the rescue subject ashore by pulling the tow line 146 secured to the buoyancy device 124.

Figure 25:
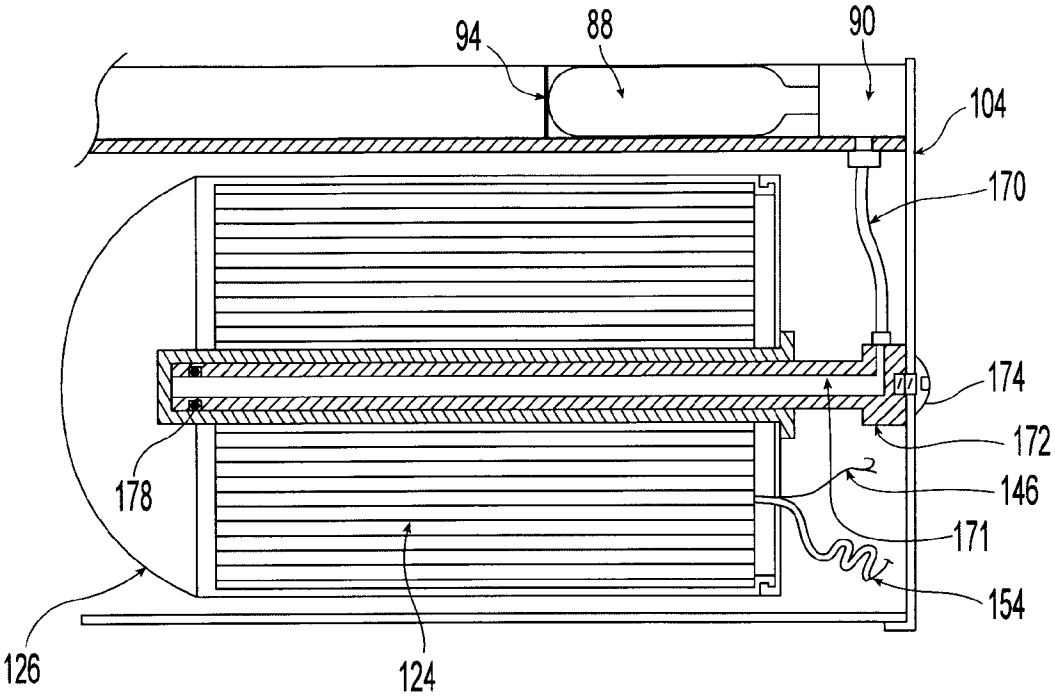
FIG. 25 is a diagrammatic view of a portion of an alterative variation of the payload cartridge of the rescue launcher system of FIGS. 1 to 3.

FIG. 25, illustrates a variation of the above-described payload cartridge 14 in which the towing projectile 78 is eliminated. Gas from the pierced gas cylinders 88 flows downward from the gas cylinder cap 90 to the lower portion of the canister 76 via pressure tubes 170 which are connected to a central passage 171 of a launch tube 172 forwardly extending from the rear canister cap 104. The illustrated launch tube 172 is secured to the rear canister cap 104 with a fastener 174 but alternatively can be fastened with any other suitable fastening means or can be integrally molded either wholly or partially with the rear canister cap 104. It is noted that the prior described launch tube 82 is not needed and the gas ports 86 are now drilled down from the pressurization tubes 84 to the lower portion of the canister 76 rather than up from the pressurization tubes 84 to the launch tube 82 as in the prior described configuration. As the pressurized gas enters the launch tube 172 it rapidly travels in a forward direction and exits the forward end of the launch tube 172 to engage a hollow tube 176 of the shell assembly and propel the shell assembly 126 in a forward direction and off of the launch tube 172. The hollow tube 176 is sized to closely slide over the launch tube 172 and has a closed forward end. The illustrated tube is secured to the rear cap 132 of the shell assembly 126 but alternately or additionally be secured to the front release cap 130 of the shell assembly 126. A seal 178 is preferably provided between the launch tube 172 and the hollow tube to minimize leakage of the pressurized gas therebetween until the shell assembly 126 is propelled therefrom. The configuration is particularly suitable for launching larger and heavier payloads, such as an "open on impact" mechanically actuated buoyancy aid payload canister.

Figure 26:
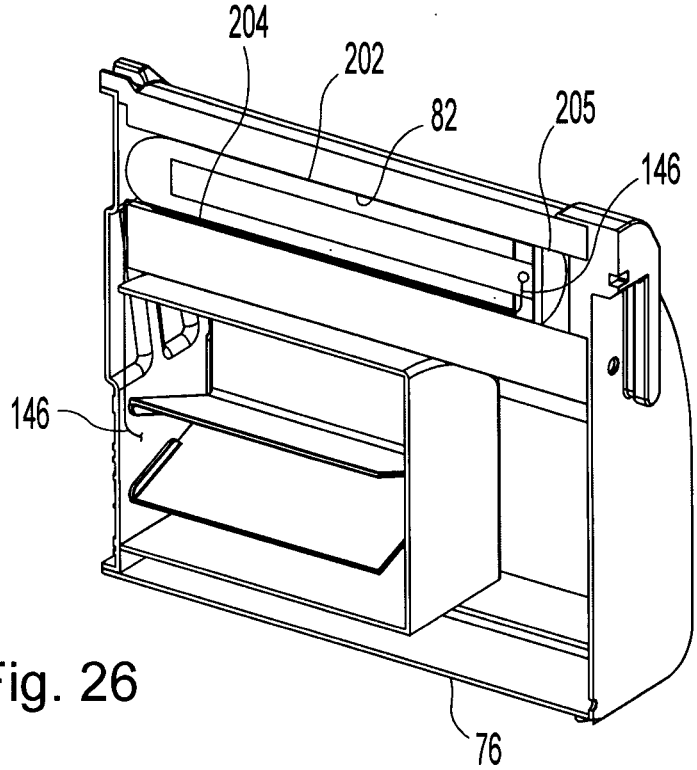
FIG. 26 is a perspective view of an alternative payload cartridge of the rescue launcher system of FIGS. 1 to 3.
Figure 27:
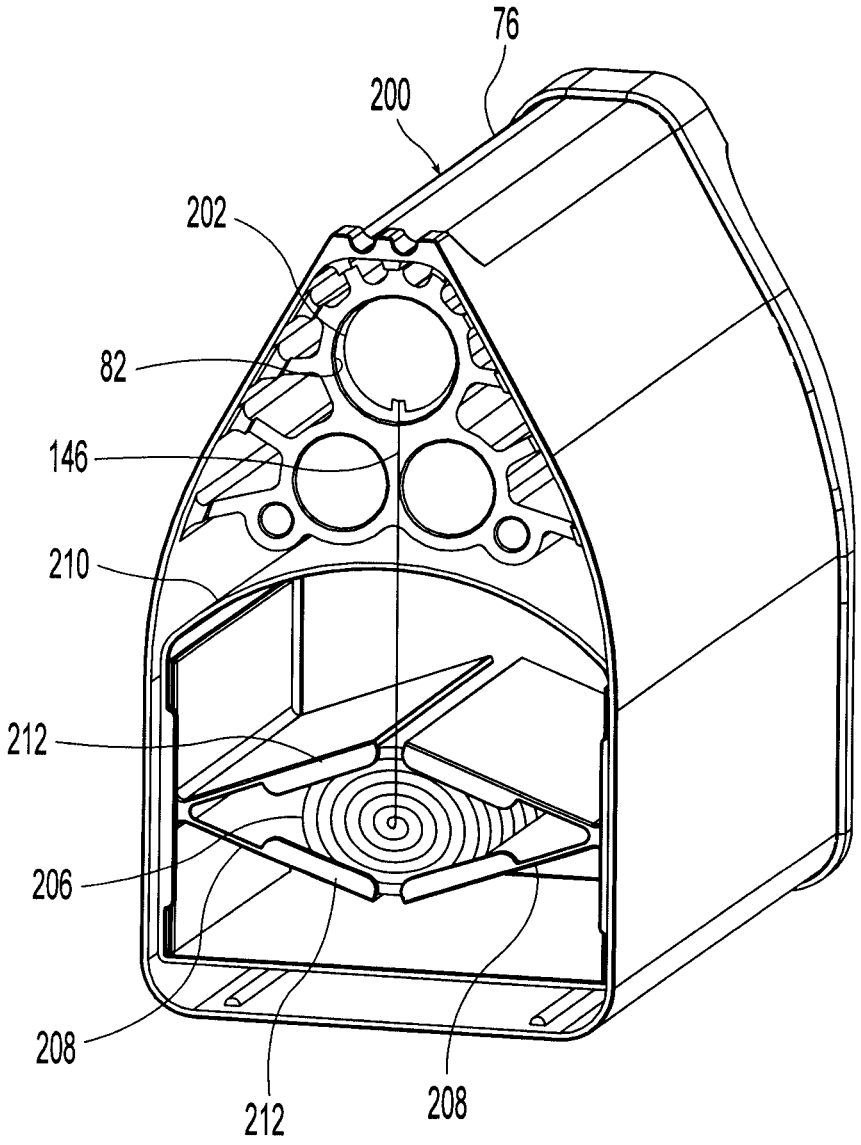
FIG. 27 is a perspective view of the payload cartridge of FIG. 26 with a front release lid removed.

FIGS. 26 and 27 illustrate an alternative payload cartridge 200 which has a payload 80 in the form of a single tow line 146. A towing projectile 202 propels the single tow line 146 for various rescue and messenger line operations, e.g., such as pulling containment booms across waterways for chemical spill containment, water and ice rescue of human subjects, and the like.

The illustrated towing projectile 202 is tubular in shape and comprises an outer shell molded of a translucent polymer (with a specific gravity under 1 so it can remain buoyant) via injection molding. The illustrated towing projectile 202 has an inner cavity in which a weighting bar of metal is installed. The weight bar amount can be varied to obtain optimal flight and distance characteristics while towing various tow line weights. The towing projectile should weigh just enough to tow the line the desired distance and maintain a low threshold of downrange kinetic energy in case a rescue subject was accidently struck by the towing projectile 202. A high visibility colorant can be added to the outer shell during molding, and/or a pocket can be provided in the front of the towing projectile 202 that can contain a miniature chemical light stick, of the variety used by fishermen as lure attraction, that fractures its internal actuation vial on impact with the front canister lid 114 upon launch, thus transmitting its light throughout the translucent outer projectile shell. This light can aid a rescue subject and rescuer to locate the towing projectile 202 and the tow line 146 in low light conditions. Alternatively, the weight bar secured to the towing projectile 202 can be used as a piston to pop forward to fracture the light stick.

The illustrated towing projective 202 has a longitudinally extending clearance side slot 204 that runs parallel with the length of the molded outer shell to allow the tow line 146 to extend from the rear of the towing projectile 202 to a forward end of the launch tube 82 where it extends down to the lower portion of the canister 76 so that the tow line 146 does not provide an unsuitable amount of frictional interference in the launch tube 82. The tow line 146 is terminated on the towing projectile 202 as described above for the first embodiment of the payload cartridge 14. Upon firing, the tow line 146 centers itself at the back of the towing projectile 202 to allow stable accurate flight characteristics while towing the tow line 146 to its destination.

A cup seal 205 is inserted into the launch tube 82 proceeding insertion of the towing projectile 202 to provide a gas tight projectile launch. The cup seal 205 is ejected as it propels the towing projectile 202 and exits the launch tube 82. Upon reaching its destination, the towing projectile 202 can be gripped by a remote rescue subject in an emergency situation for towing of the rescue subject to a safe location by pulling the tow line 146 secured to the towing projectile 202. The tow line 146 can be high strength small diameter cord constructed of a material such as Spectra®, Dyneema® or the like. For non-critical use of the tow line 146, a low cost material such as Dacron®, nylon, or the like can be substituted.

In conjunction with the single line towing projectile payload configuration, a pre-wound spool 206 of the tow line 146 can be utilized. The illustrated spool 206 is held in place by a pair of spool retention inserts 208 that is adapted to hold a variety of spool diameters and is located in the lower portion of the canister 76. The inserts 208 can be molded from a flexible plastic material such as, for example polyethylene or the like. The illustrated inserts 208 are generally "K" shaped and face each other from opposite sides of the canister 76 to hold the spool 206 therebetween but allow the tow line 146 to pay out of the center of the spool 206. The inserts 208 could spring in demand to the diameter of the line spool 206 by being restrained in a canister cartridge housing insert 210. The spool 206 is retained via tabs 212 located on the front of the inserts 208 which do not impede rapidly withdrawing the tow line 146 from the center of the spool 206 by the towing projectile 202. It is noted that the inserts 208 can alternatively have any other suitable configuration. The retainer inserts 208 and the housing insert 210 are each preferably injection molded of a suitable plastic material.

Figure 30:
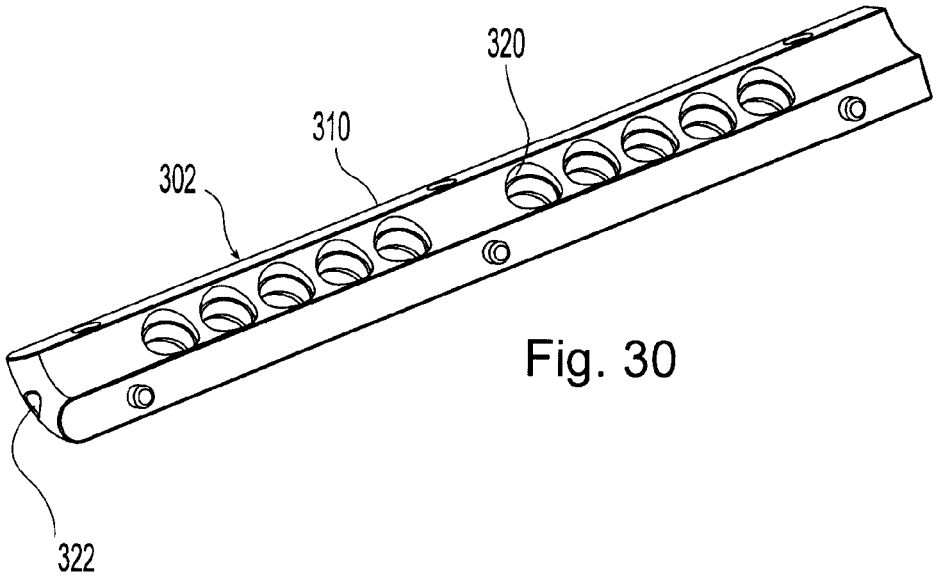
FIG. 30 is a perspective view of a tow projectile segment of the payload cartridge of FIG. 28.
Figure 28:
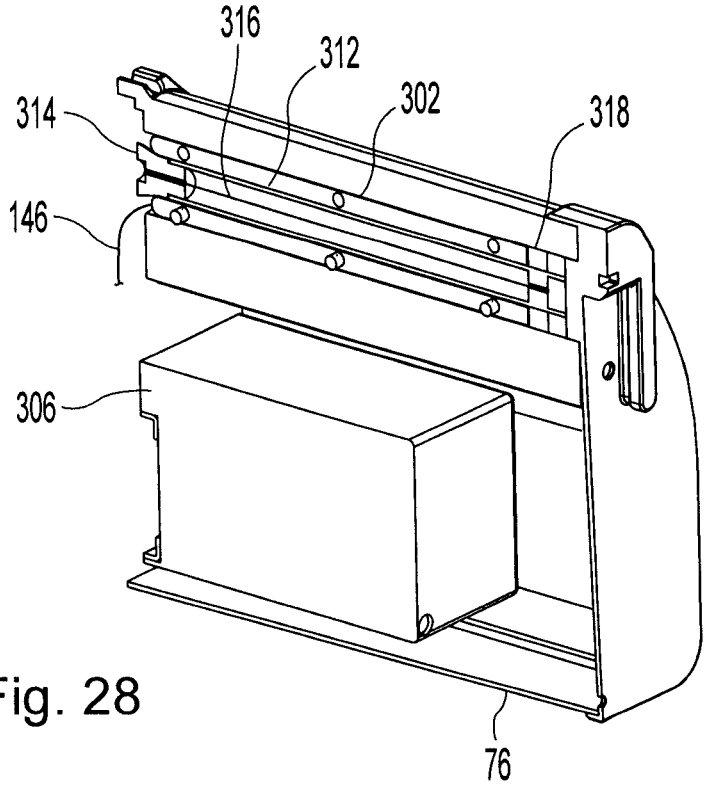
FIG. 28 is a perspective view of another alternative payload cartridge of the rescue launcher system of FIGS. 1 to 3.
Figure 29:
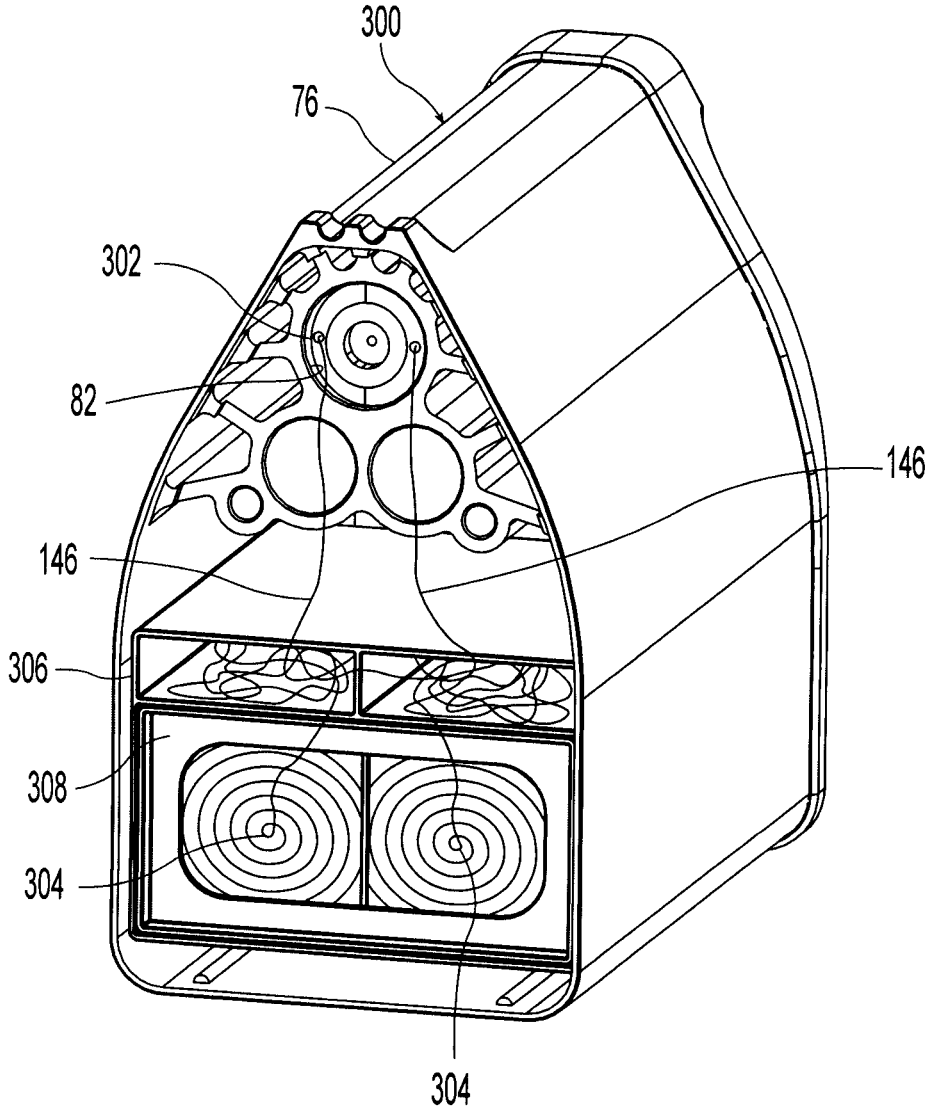
FIG. 29 is a perspective view of the payload cartridge of FIG. 28 with a front release lid removed.

FIGS. 28 to 30 illustrate another alternative payload cartridge 300 in which the payload 80 is in the form of a rescue snare. It is envisioned that the rescue snare may limit the need for rescuers to enter dangerous water or ice conditions to facilitate a rescue. This is extremely important for first responders who do not have assistance and the importance to rescue a human or animal as rapidly as possible. It is also envisioned the rescue snare can be utilized in commercial settings to snare an object for recovery or rope transfer operations onto unmanned locations.

The illustrated rescue snare includes a two segment towing projectile 302 to pull two interconnected high strength retrieval or tow lines 146, at an angle to each other from two spools 304 of the tow line 146. The illustrated rescue snare is deployed out of the above-described pre-packed one-time-use disposable payload cartridge with a "compartment creating" insert 306 that allows packing the two tow lines 146 in an appropriate manner to limit tangling. The two spools 304 of the two lines 146 are stored in separate compartments of the insert 306 and retained in the compartments with a front retention cap 308. The illustrated insert 306 also forms packing compartments for a cross connected line and shroud lines as described in more detail hereinafter. Alternatively, the spools 304 can be held similar to the spool 206 for the single tow line embodiment described above or in any other suitable manner. The insert 306 and the retention cap 308 are each preferably injection molded of a suitable plastic material.

Attached at the towing projectile line end, is a cross connected line or narrow piece of high strength large mesh netting of an appropriate length such as, for example, 15 ft. long. Two relatively short such as, for example, about 12" long shroud lines are connected to the rescue line or net at the appropriate cross length endpoints. Along the top surface of this line or netting, a flotation device or devices or a floating line can be utilized such as, for example, Spectra®, polypropylene, float treated nylon or the like that keeps the line or net from sinking. The rescuer end of the tow lines 146 could be fixed to a non-movable object by a "pull out" line attached to the lines to minimize possibility of loss upon launch.

The two segment towing projectile 302 can be molded from a polymer material with a specific gravity index less than 1.0 so it will float in water. As best shown in FIG. 30, the tubular shaped towing projectile 302 can be molded in quarter segments 310 that key together with mating pins to minimize tooling costs so the segments 310 would be available for other applications requiring four segments 310 such as, for example, square or rectangular nets. Two of the quarter segments 310 are glued together or otherwise secured together to form the two segments necessary for the illustrated rescue snare. It is noted that alternatively the towing projectile 302 can simply be molded in halves to form the two segments. The illustrated quarter segments 310 have internal stepped pockets 320 in which a soft non-toxic metal can be swaged to generate sufficient weight for deployment. Additionally, the illustrated quarter segments 310 are provided with a bore 322 in the end of the segments 310 for attachment of the shroud or tow lines 146 by wedge pins, glue, or the like.

A hollow deflector tube 312 is mounted within the launch tube 82 in a cantilevered manner with a deflector button 314 located the forward distal end of the deflector tube 312. A suitable length of high strength cord 316 would attach the deflector button 314 to the hollow deflector tube 312. The cord 316 is stored within the hollow deflector tube 312. A concentric cup seal 318 is inserted into the space created between the deflector tube 312 and the launch tube 82 that seals on the surface of the launch tube 82 and the concentrically placed deflector tube 312. The split, two section towing projectile 302 is pushed onto the deflector tube 312 with its split positioned vertical in reference to the ground, followed by the deflector button 314 being secured to the end of the deflector tube 312. The illustrated rescue snare system utilizes the above-describe pressurization system 32 for launch of the towing projectile 302. As the towing projectile 302 exits the deflector tube 312, the deflector button 314 deflects and separates the two segments of the towing projectile 302.

The deflector button 314 can be adapted for any desired angle of separation for the two segments of the towing projectile 302.

In use, the rescuer centers the rescue subject up in the sights 30, 74 of the reusable launcher 12 and fires the two segments of the towing projectile 302 beyond the rescue subject. The segments of the towing projectile 302 separate and deploy the cross connected line or netting to its maximum length and drop the netting or cross connected line into the water or on the ice beyond the rescue subject. Even if the tow lines 146 drift to one side of the rescue subject due to wind or an inaccurate shot, as long as the cross line is beyond the rescue subject, the rescuer can "flip" one of the previously deployed towlines 146 like a jump rope to position the line loop over the rescue subject. The rescuer can then simultaneously tow the two tow lines 146 back towards the shore and snare the rescue subject in the cross line or netting to allow the rescue subject to be towed safely to shore. If it is desired to utilize the line loop as a messenger line, one end of the line loop at the operator end can be attached to a heavier line and relayed around a rescue subject or object by pulling on the opposite end of the line loop.

It is noted that each of the features and variations of the above disclosed embodiments can be used in any combination which each of the other embodiments.

From the foregoing disclosure it is apparent that the rescue launcher system of the present invention utilizes injection molding as a primary method of manufacture for a majority of the components so that the disclosed rescue launcher systems lend themselves as low-cost alternatives to many existing rescue launcher systems on the market. Thus, the disclosed rescue launcher systems can be widely adopted for many locations and applications. Due to low cost and ease of use by novice operators, it is believed that the disclosed rescue launcher systems can replicate the "automatic external defibrillator deployment model" for heart attack victims by providing rescue launcher systems in high risk public water areas in alarmed "break-the-glass" enclosures or the like.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A rescue launcher system comprising, in combination:

a reusable launcher;

a one-time-use, pre-packed payload cartridge removably secured to the reusable launcher;

wherein the payload cartridge includes a plastic canister, a plastic rear cap secured to the rear end of the canister and closing a rear end of the canister, plastic front lid removably secured to a front end of the canister and closing the front end of the canister, a pressurization system located within the canister and selectively activated by the reusable launcher, and a payload located within the canister and which is launched through the front end of the canister to a remote location upon actuation of the pressurization system by the reusable launcher; and wherein the plastic rear cap is removably secured to the reusable launcher to secure the canister and the pressurization system to the reusable launcher as the payload is launched from the canister through the front end of the canister.

2. The rescue launcher system according to claim 1, wherein the payload is one of a buoyancy device, a single tow line, and a snare having two tow lines.

3. The rescue launcher system according to claim 1, wherein the pressurization system includes at least one pre pressurized gas cartridge and a puncture pin for selectively puncturing the at least one gas cartridge.

4. The rescue launcher system according to claim 1, wherein the pressurization system includes at least one gunpowder based gas generation cartridge and a firing pin for selectively igniting the at least one gas generation cartridge.

5. The rescue launcher system according to claim 1, wherein the reusable launcher has an actuation grip for selectively actuating the pressurization system to launch the projectile through the front end of the canister; and an interlock spaced from the actuation grip and including a push button spring biased away from a depressed position, and wherein the interlock is configured to prevent actuation of the pressurization system unless the push button is pushed to the depressed position while the actuation grip is simultaneously actuated and is configured to prevent further actuation of the actuation grip and actuation of the pressurization system when the push button is released and resiliently biased out of the depressed position during actuation of the actuation grip.

6. The rescue launcher system according to claim 5, wherein the actuation grip and the interlock are spaced apart so that two a single hand cannot simultaneously actuate both the actuation grip and the interlock push button and the actuator grip and the push button can only be simultaneously actuated by depressing the push button with a first hand and actuating the actuator grip with a second hand.

7. The rescue launcher system according to claim 6, wherein the actuation grip is located at a rear grip near a rear end of the reusable launcher and the interlock is located at a front grip near a forward end of the reusable launcher.

8. The rescue launcher system according to claim 1, wherein the rear cap is removed from the reusable launcher by sliding the rear cap upwardly relative to the reusable launcher.

9. The rescue launcher system according to claim 1, wherein the reusable launcher has a detent that cooperates with an opening in the rear cap to prevent unintended disengagement of the rear cap from the reusable launcher by upward movement of the rear can relative to the reusable launcher.

10. A rescue launcher system comprising, in combination:

a reusable launcher having an actuation grip and an interlock;

a payload cartridge removably secured to the reusable launcher;

wherein the payload cartridge includes a plastic canister, a plastic rear cap secured to the rear end of the canister and closing a rear end of the canister plastic front lid removably secured to a front end of the canister and closing the front end of the canister, a pressurization system located within the canister and selectively activated by the reusable launcher, and a payload located within the canister and which is launched through the front end of the canister to a remote location upon actuation of the pressurization system by the reusable launcher; and wherein actuation of the actuation grip actuates the pressurization system to launch the projectile through the front end of the canister; and wherein the interlock includes a push button spring biased away from a depressed position is configured to prevent actuation of the pressurization system unless the push button is pushed to the depressed position while the actuation grip is simultaneously actuated, and is configured to prevent further actuation of the actuation drip and actuation of the pressurization system when the push button is released and resiliently biased out of the depressed position during actuation of the grip.

11. The rescue launcher system according to claim 10, wherein the payload is one of a buoyancy device, a single tow line, and a snare having two tow lines.

12. The rescue launcher system according to claim 10, wherein the pressurization system includes at least one pre-pressurized gas cartridge and a puncture pin for selectively puncturing the at least one gas cartridge.

13. The rescue launcher system according to claim 10, wherein the pressurization system includes at least one gunpowder based gas generation cartridge and a firing pin for selectively igniting the at least one gas generation cartridge.

14. The rescue launcher system according to claim 10, wherein the actuation grip and the interlock are spaced apart so that a single hand cannot simultaneously actuate both the actuation grip and the interlock push button and the actuator grip and the push button can only be simultaneously actuated by depressing the push button with a first hand and actuating the actuator grip with a second hand.

15. The rescue launcher system according to claim 14, wherein the actuation grip is located at a rear grip near a rear end of the reusable launcher and the interlock is located at a front drip near a forward end of the reusable launcher.

16. A rescue launcher system comprising, in combination:

a reusable launcher;

a payload cartridge removably secured to the reusable launcher;

wherein the payload cartridge houses a buoyancy device which is launched to a remote location upon actuation of the reusable launcher; and wherein the buoyancy device includes a sealed tube and foam within the sealed tube and the sealed tube and foam mechanically restrained in a compressed state and configured to inflate using internal vacuum when no longer mechanically restrained after launch of the buoyancy device.

17. The rescue launcher system according to claim 16, wherein the buoyancy device includes a float assembly having an air inlet and an air outlet in communication with the interior of the sealed tube, and a one-way check valve permitting air flow into the sealed tube but not out of the sealed tube.

18. The rescue launcher system according to claim 17, wherein the air inlet is provided with hydrophobic filter material which allows air to flow in but blocks inflow of water.

19. The rescue launcher system according to claim 16, wherein the sealed tube comprises flexible plastic.

20. The rescue launcher system according to claim 16, wherein the foam comprises open cell foam.

* * * * *